US005125991A

United States Patent [19]

Ishitobi et al.

[11] Patent Number: 5,125,991

[45] Date of Patent: Jun. 30, 1992

[54] SILICON STEEL SHEETS HAVING LOW IRON LOSS AND METHOD OF PRODUCING THE SAME

[75] Inventors: Hirotake Ishitobi; Ujihiro Nishike; Shigeko Sujita; Tikara Kami; Yasuhiro Kobayashi, all of Chiba, Japan

[73] Assignee: Kawasaki Steel Corporation, Japan

[21] Appl. No.: 600,136

[22] Filed: Oct. 19, 1990

Related U.S. Application Data

[63] Continuation of Ser. No. 240,931, Sep. 6, 1988, abandoned.

[30] Foreign Application Priority Data

| | | | |
|---|---|---|---|
| Sep. 10, 1987 | [JP] | Japan | 62-225149 |
| Sep. 26, 1987 | [JP] | Japan | 62-241093 |
| Jul. 4, 1988 | [JP] | Japan | 63-164873 |

[51] Int. Cl.[5] ..... H01F 1/04

[52] U.S. Cl. ..... 148/308; 420/117

[58] Field of Search ..... 148/308; 420/117

[56] References Cited

U.S. PATENT DOCUMENTS

| | | | |
|---|---|---|---|
| 2,700,006 | 1/1955 | Dunn | 148/308 |
| 3,159,511 | 12/1964 | Taguchi et al. | 148/111 |
| 3,932,236 | 1/1976 | Wada et al. | 148/308 |
| 4,203,784 | 5/1980 | Kuroki et al. | 148/308 |
| 4,318,758 | 3/1982 | Kuroki et al. | 148/111 |

FOREIGN PATENT DOCUMENTS

| | | |
|---|---|---|
| 0229646 | 7/1987 | European Pat. Off. . |
| 52-24499 | 7/1977 | Japan . |
| 56-4150 | 1/1981 | Japan . |
| 60-39123 | 2/1985 | Japan . |
| 60-89589 | 5/1985 | Japan . |

OTHER PUBLICATIONS

"New Grain-Oriented Silicon Steel Orientcore Hi-B", by Satoru Taguchi et al., Nippon Steel Technical Report Overseas No. 4, Nov. 1973, pp. 1-10.

Chemical Abstracts, vol. 83, No. 12, Sep. 22, 1975, Columbus, Ohio, U.S.A.; Kitayama et al., "Forming insulation film on silicon steel plate", p. 274, Abstract no. 101 790b & Japan 74 46 219.

*Primary Examiner*—John P. Sheehan

*Attorney, Agent, or Firm*—Miller & Christenbury

[57] ABSTRACT

A silicon-containing steel sheet having a low iron loss has such a crystal structure that crystal grains having an inclination angle of {110} face of not more than 10° with respect to the sheet surface are included in an amount of not less than 80 vol % and exhibit a graining surface pattern in which boundaries of these crystal grains form stepwise difference or groove of not less than 0.4 μm as a maximum height. This sheet is produced by subjecting a grain oriented silicon steel sheet after final annealing to a magnetically smoothening treatment by electrolysis in an squeous solution containing at least one of water soluble halides.

2 Claims, 5 Drawing Sheets

SILICON STEEL SHEETS HAVING LOW IRON LOSS AND METHOD OF PRODUCING THE SAME

This application is a continuation of application Ser. No. 07/240,931, filed Sep. 6, 1988, now abandoned.

BACKGROUND OF THE INVENTION

1. Field of the Invention

This invention relates to silicon-containing steel sheets having not only excellent magnetic properties but also good adhesion to a coating.

2. Related Art Statement

On the border of the energy crisis since several years, industry strongly tends to request electrical machinery and apparatus having less power loss. For this purpose, it becomes important to develop electromagnetic steel sheets having much lower iron loss as a core material for these machineries and apparatuses.

As the conventional method of producing grain oriented silicon steel sheets, there is usually performed a method wherein a starting material containing, for example, 2.0–4.0% by weight (hereinafter shown by % simply) of Si is hot rolled and subjected to a heavy cold rolling at once or two-times cold rolling through an intermediate annealing step to provide a final sheet thickness, and then the resulting cold rolled sheet was decarburization-annealed, coated with a slurry of an annealing separator composed mainly of MgO and wound in the form of a coil, and thereafter the coil is subjected to secondary recrystallization annealing and purification annealing (these two annealing steps are usually performed in one process. Hereinafter, the term "final annealing" is used) and further to a phosphate insulation coating if necessary.

In the above purification annealing, a forsterite ($Mg_2SiO_4$) coating is formed by reacting an oxide layer of $SiO_2$ produced on the surface of the steel sheet after the decarburization annealing with MgO contained in the annealing separator.

The grain oriented silicon steel sheets are obtained by aligning secondary recrystallized grains into (110)[001] orientation or Goss orientation through the above production steps and mainly used as a core for transformers and other electrical machineries. For this end, they are required to have a high magnetic flux density (exemplified by $B_{10}$ value) and a low iron loss (exemplified by $W_{17/50}$ Value) as the properties of the grain oriented silicon steel sheet. Particularly, it is recently demanded even more to reduce the iron loss for lessening the power loss of the transformer or the like from a viewpoint of energy-saving.

The iron loss of the silicon steel sheet is a sum of eddy current loss and hysteresis loss. As an effective means for reducing the iron loss of the silicon steel sheet, there is a method of reducing the sheet thickness, which mainly reduces the eddy current loss and largely contributes to the reduction of iron loss and hence the energy-saving. However, as the sheet thickness becomes not more than 11 mil, the ratio of the hysteresis loss occupied in total iron loss rapidly increases. As a factor effecting the hysteresis loss, mention may be made of orientation of crystal grain, amount of impurities, influence of surface coating, roughness of sheet surface and the like.

As a method of reducing the hysteresis loss by particularly improving the surface properties of the steel sheet, for instance, Japanese Patent Application Publication No. 52-24,499 proposes a method wherein a grain oriented silicon steel sheet after final annealing is pickled to remove oxides from the surface and is then rendered into a mirror state by subjecting it to a chemical polishing or an electrolytic polishing. Furthermore, Japanese Patent Application Publication No. 56-4,150 discloses a technique wherein the surface of the grain oriented silicon steel sheet is subjected to a chemical or electrolytic polishing after the removal of non-metallic substance and then coated with a ceramic thin film. And also, Japanese Patent laid open No. 60-89,589 discloses a technique wherein the surface of the grain oriented silicon steel sheet after the secondary recrystallization using an annealing separator composed mainly of alumina is subjected to a chemical or electrolytic polishing after the removal of oxides from the surface. Moreover, Japanese Patent laid open No. 60-39,123 discloses a technique wherein the grain oriented silicon steel sheet is subjected to a chemical or electrolytic polishing without direct pickling after the amount of oxide formed on the surface is controlled by using an annealing separator composed mainly of alumina.

However, these techniques clearly show the effect of reducing the iron loss, but they are not yet practised in industry. Because, in case of the chemical polishing, $HF+H_2O_2$, $H_3PO_4+H_2O_2$ or the like used as a polishing solution is expensive, resulting in an increase of the cost. On the other hand, in case of the electrolytic polishing, all of phosphoric acid bath, sulfuric acid bath, phosphoric acid-sulfuric acid bath, perchloric acid bath and the like have a high concentration of acid as a main ingredient and also contain a chromate, fluoric acid, organic compound or the like as an additive, so that they are high in cost and cause many unsolved problems on homogeniety, productivity, premature degradation of solution and the like when treating a great amount of steel sheet.

Furthermore, a great drawback obstructing the industriallization is that the insulation coating is hardly adhered onto the mirror finished surface of the sheet. That is, the conventionally known phosphate coating, ceramic coating and the like are poor in adhesion property due to the mirror surface and are not durable in practical use.

SUMMARY OF THE INVENTION

It is, therefore, an object of the invention to advantageously solve the aforementioned problems and to provide silicon-containing steel sheets having a magnetically smooth surface, i.e. a surface not obstructing the movement of magnetic domain walls which cause hysteresis loss, without performing a mirror finishing treatment through the electrolytic or chemical polishing but having an excellent adhesion property to a coating.

The inventors have made various studies with respect to the influence of the surface upon the iron loss and found the following.

Namely, a first finding lies in that a factor largely influencing the hysteresis loss is mainly an oxide existent on the surface, a mirror state is not necessarily required to make the movement of magnetic domain walls smooth. The term "mirror state" used herein is an optical concept and is not quantitatively defined, but usually indicates that the surface roughness is not more than 0.4 μm, particularly not more than 0.1 μm as a center-line average roughness.

FIG. 2 shows a comparison in iron loss among a conventional grain oriented silicon steel sheet having an oxide an its surface, a grain oriented silicon steel sheet when a conventional sheet is subjected to a mirror finishing treatment, and a grain oriented silicon steel sheet when the mirror finished surface is subjected to pickling. As seen from FIG. 2, the iron loss property is not so degraded even if the mirror state is lost by pickling.

Thus, in order to obtain a low hysteresis loss silicon steel sheet, the mirror surface is not always required, and the surface of the steel sheet is sufficient to be a magnetically smooth surface, i.e. a surface not obstructing the movement of magnetic domains which causes hysteresis loss. Therefore, electrolytic polishing and chemical polishing are not indispensable conditions, and the surface treating means may be selected more freely.

However, the introduction of strain into the surface of the silicon steel sheet during the magnetic smoothening process degrades the iron loss property, so that it should be avoided as far as possible, and hence a chemical strain-free polishing process is suitable.

The mirror finishing phenomenon characterized by the electrolytic polishing method will be described below. In electrolytic polishing, when current is passed in an electrolytic solution of strong acid or strong alkali by using a surface to be polished as an anode, metal is dissolved out from the surface as an ion by the electrolytic reaction, while a viscous film is formed between the metal surface and the electrolytic solution. Since such a viscous film is thin at the convex portion of the surface and the current flows strongly thereto, the convex portion is largely dissolved out as compared with the concave portion and finally the metal surface is rendered into an even mirror finished surface. Therefore, the chemical or electrolytic polishing is said to be a method of smoothening the metal surface independently of crystal grain size and crystal orientation. In other words, the surface obtained by the chemical or electrolytic polishing provides a smooth surface having a high gloss irrespective of the crystal orientation of the base metal.

A second finding lies in that the surface state of the silicon steel sheet largely differs in accordance with the difference of crystal orientation when the sheet is subjected to an anodic electrolytic treatment in an aqueous halide solution.

Heretofore, electrolytic treatment through a halide was scarcely carried out because the actual effect of obtaining the mirror polished surface was poor. However, the inventors have widely searched the possibility of electrolytic treatment under the above first finding and have found the above mentioned peculiar phenomenon as a result of confirmation experiments with a halide.

FIG. 3 shows a microphotograph of a sheet surface having different crystal face morphologies after the anodic electrolytic treatment in an aqueous NaCl solution as a halide, wherein A, B, and C are enlarged photographs of various morphologies of the crystal grains, respectively.

In FIG. 3, A is a case where the {110} face of the crystal grains is inclined at an angle of 5° with respect to the rolling surface and exhibits a peculiar network surface morphology. This network surface is called a graining pattern surface because it closely resembles a graining surface obtained by electrolytic etching, characterized by dispersing and adjoining recesses each apparently seeing the crystal grain into the grains. B is a case where the crystal face is inclined at an angle of 11° with respect to the rolling surface and exhibits a scale-like morphology. C is a case where the crystal face is inclined at an angle of 25° with respect to the rolling surface and exhibits a fine-grained texture. As shown in A to C in FIG. 3, the surface having these peculiar morphologies is not a mirror surface even in the network texture A, and exhibits an aspect similar to a pickled surface appearing crystal grain boundary as a macro appearance.

Further, it is important that the surface having such a peculiar network texture is obtained only by subjecting the silicon steel sheet having {110} face to an electrolytic treatment with an aqueous chloride solution as an electrolytic solution and that the network texture is a magnetically smooth surface which means that the hysteresis loss is very small.

A third finding lies in that the graining pattern surface has a larger magnetic flux density as compared with the mirror surface obtained by the conventional electrolytic polishing treatment. Therefore, the silicon-containing steel sheets based on the above finding become low in the production cost and are excellent in the magnetic properties as compared with the case using the conventional mirror finishing treatment.

In the silicon-containing steel sheet, an insulation coating is frequently provided on the surface of the sheet. Furthermore, a tension may be applied to the insulation coating or a double coating of tension applied coat and insulation coat may be formed in order to further improve the magnetic properties such as magnetostriction, iron loss and the like. However, the surface obtained by the conventional mirror polishing as a means for obtaining a magnetically smooth surface is difficult to provide with these coatings and also is poor in adhesion to the coating.

On the contrary, it has been confirmed that the surface of the steel sheet obtained by the anodic electrolytic treatment in the aqueous halide solution is excellent in adhesion to the insulation coating as compared with the mirror surface obtained by chemical or electrolytic polishing. However, since there is caused a scattering in adhesion to the coating in accordance with the kind and thickness of the insulation coating, the improvement of such a surface state has been attempted by subjecting it to the usual brushing treatment, but satisfactory, results were not yet obtained. Now, the inventors have examined the cause of degrading the adhesion to the coating and found that a hydrated oxide of Fe and smut not removed only by the usual brushing treatment and remaining on the sheet surface influence the adhesion to the coating. Furthermore, it has been found that it is very effective to subject the sheet surface after electrolysis to a brushing treatment with an aqueous solution or suspension of a hydrogen carbonate for removing the hydrated oxide and smut and also a clear surface is provided by this treatment to sufficiently improve the adhesion property to the coating.

BRIEF DESCRIPTION OF THE DRAWINGS

The invention will be described with reference to the accompanying drawings, wherein.

DESCRIPTION OF THE PREFERRED EMBODIMENTS

Figure 1A:
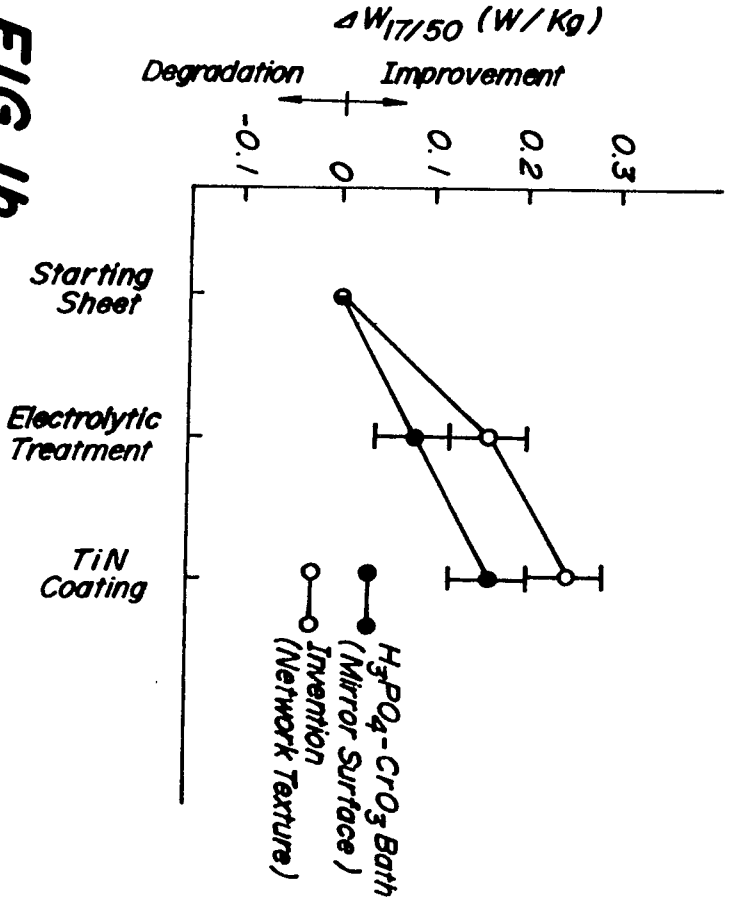
FIGS. 1*a* and 1*b* are graphs showing the improved margins of iron loss and magnetic flux density when the surface of the grain oriented silicon steel sheet is subjected to an anodically electrolytic treatment in a phosphoric acid-chromic acid bath or a halide bath or further provided thereon with a coating of TiN, respectively.

The invention is based on the aforementioned findings. That is, according to a first aspect of the invention, there is provided a silicon-containing steel sheet having a low iron loss, characterized in that said sheet has a crystal structure that crystal grains having an inclination angle of {110} face of not more than 10° with respect to the sheet surface are included in an amount of not less than 80 vol % and surfaces of these crystal grains at said sheet surface exhibit a graining pattern and boundaries of these crystal grains form a stepwise difference or groove of not less than 0.4 μm as a maximum height Rmax. In a preferred embodiment of the invention, the sheet is provided at its surface with a tension-applied type insulation coating.

According to a second aspect of the invention, there is the provision of a method of producing a silicon-containing steel sheet having a low iron loss, which comprises subjecting a grain oriented silicon steel sheet after final annealing to a magnetic smoothening treatment by electrolysis in an aqueous solution containing at least one of the water soluble halides.

In another embodiment of the invention, the aqueous solution further contains a polyether or a corrosion preventive agent. In another embodiment of the invention, the sheet surface after the magnetically smoothening treatment is subjected to a brushing treatment in an aqueous solution or suspension of a hydrogen carbonate, or the final annealed sheet is subjected to a mechanical polishing treatment giving a small strain to the base metal surface before the magnetically smoothening treatment.

According to the invention, the silicon-containing steel sheet must have a crystal structure with crystal grains having an inclination angle of {110} face of not more than 10° with respect to the sheet surface (or base metal surface) which are included in an amount of not less than 80 vol % per total volume. When the inclination angle of {110} face exceeds 10°, the surface after the electrolytic treatment in the halide bath changes from a network texture to scale-like or further fine-grained texture to lose magnetic smoothness. Furthermore, when the ratio of crystal grains in such a preferred orientation is less than 80 vol %, the magnetically non-smooth surface becomes large and the iron loss is increased by the electrolytic treatment.

Moreover, the starting sheet for the production of such silicon-containing steel sheet is obtained by subjecting a slab for making silicon steel sheet to hot rolling and further to cold rolling through an intermediate annealing to provide final sheet thickness in the usual manner and then subjecting the cold rolled sheet to decarburization annealing and further to a final annealing. In the final annealing, an annealing separator composed mainly of MgO is used for simultaneously forming a forsterite coating, but a separator consisting essentially of $Al_2O_3$ and containing an inert MgO, Ca or Sr compound may be used so as not to form the forsterite coating.

Further, in the sheet surface according to the invention, the crystal grain boundaries form stepwise- or groove-like concave portions of not less than 0.4 μm as Rmax, and the surface of these crystal grains exhibits a pattern adjoining recesses through the border of convex portions, i.e. graining pattern. Thus, the adhesion property to the coating formed on the sheet surface is increased by the border of the convex portion and the crystal grain boundary of the concave portion and also the width of the magnetic domain becomes fine through the stepwise- or groove-like grain boundary to improve the iron loss value.

And also, such a graining pattern is characterized by having a magnetic flux density (as measured at 1,000 Am) higher by about 200–300 gauss as compared with the mirror surface obtained by the conventional electrolytic polishing.

Moreover, the reason why the depth of the stepwise- or groove-like concave portion in the crystal grain boundary is limited to not less than 0.4 μm as Rmax is due to the fact that when the depth is less than 0.4 μm, the effect of improving the iron loss property and adhesion property is poor.

According to the invention, the magnetically smooth graining pattern (or texture) is easily obtained by subjecting the silicon steel sheet to an anodic electrolytic treatment in an aqueous solution containing at least one of water soluble halides or an electrolytic solution containing at least one water soluble halide and a polyether.

The term "water soluble halide" used herein means HCl, $NH_4Cl$, chlorides of various metals, water soluble substances among acids containing F, Br, I as a cationic ion, salts of these acids with alkali, alkaline and other metals and ammonium salt thereof, and water soluble substances including borofluorides ($BF_4$ salt) and silifluorides ($SiF_6$ salt) as a fluoride. As the water soluble halide, mention maybe made of HCl, NaCl, KCl, $NH_4Cl$, $MgCl_2$, $CaCl_2$, $AlCl_3$, HF, NaF, KF, $NH_4F$, HBr, NaBr, KBr, $MgBr_2$, $CaBr_2$, $NH_4Br$, HI, NaI, KI, $NH_4I$, $CaI_2$, $MgI_2$, $H_2SiF_6$, $MgSiF_6$, $(NH_4)_2SiF_6$, $HBF_4$, $NH_4BF_4$, $NaBF_4$ and the like. These halides have a magnetically smoothening effect to the final annealed grain oriented silicon steel sheet having {110} crystal face, so that it is desirable to select a proper substance among these halides considering prevention of precipitating metal onto a cathode and the like in the actual operation. Further, the concentration of the halide is desirable to be not less than 20 g/l for ensuring the conductivity of the bath. Moreover, the use of sea water is possible in the invention from a viewpoint of its composition and concentration.

The polyether is added for effectively improving the iron loss property when the steel sheet is subjected to anodic electrolysis while the concentration of the halide is much reduced. This polyether is a linear high polymer compound containing an ether bond (—O—) in its main chain and generally consisting of a repeated unit [MO], wherein M is usually a methylene group, a polymethylene group or its derivative. Polyethylene glycol $+CH_2CH_2O+$ is a typical example of the polyether.

The amount of the polyether added is desirably not less than 2 g/l. On the other hand, when it is too large, the conductivity of the bath lowers and also the addition effect can not be expected, so that the upper limit is about 300 g/l.

The bath temperature may be optionally selected from room temperature or more. However, when the bath temperature is too high, the evaporation of water becomes conspicuous, so that it is suitable within a range of from room temperature to about 90° C. Furthermore, the current density may be set within a range of from about 5 A/dm$^2$ to several hundred A/dm$^2$. However, when the bath temperature is low, if the current density exceeds 100 A/dm$^2$, the treated surface is apt to become uneven, so that if it is intended to widen the range of current density, the bath temperature should be not lower than 40° C.

From a viewpoint of reducing the iron loss, according to the invention, it is preferable that the electric quantity of the electrolysis and the removal amount through the electrolysis are not less than 300 C/dm$^2$ and not less than 1 $\mu$m per surface, respectively.

As mentioned above, according to the invention, the magnetic smoothening effect can be obtained under very wide range of conditions as compared with the conventional method, which becomes an important foundation advantageous in industrially practical use.

The change of the bath through the electrolysis reaction will be described by using an aqueous solution of NaCl as follows.

$$\text{Anode: } Fe + 2Cl^- \rightarrow FeCl_2 + 2e^- \quad (1)$$

$$\text{Cathode: } 2Na^- + 2H_2O + 2e^- \rightarrow 2NaOH + H_2 \uparrow \quad (2)$$

$$\text{Bulk: } FeCl_2 + 2NaOH \rightarrow 2NaCl + Fe(OH)_2 \downarrow \quad (3)$$

That is, $FeCl_2$ produced by the equation (1) and NaOH produced by the equation (2) are reacted according to the equation (3) to automatically reproduce NaCl. Therefore, the control of the bath composition is fundamentally carried out by removal of $Fe(OH)_2$ precipitate produced by the equation (3), supplement of water, and compensation of NaCl for taking out with the steel sheet to the outside, so that it is fairly easy and low in cost as compared with the conventional chemical or electrolytic polishing. This is a merit of the invention in industrial practice.

In the preferable embodiment of the invention, after the anodically electrolytic treatment in the aqueous halide solution, the halide is washed out from the sheet surface with water, and then the surface is subjected to a brushing treatment with an aqueous solution or suspension of a hydrogen carbonate for improving the adhesion property to a coating through surface cleaning. The hydrogen carbonate includes sodium hydrogen carbonate, ammonium hydrogen carbonate, potassium hydrogen carbonate and the like. In case of the aqueous solution, the concentration is desired to be not less than 10 g/l because when it is less than 10 g/l, the surface cleaning effect is not sufficient. Moreover, the cleaning effect becomes large as the concentration becomes high, so that it is conspicuous when using the aqueous suspension. However, a clear effect can be obtained at a concentration of not less than 10 g/l as compared with the brushing treatment with water. In the brushing, a brush roll made of synthetic fiber or natural fiber, a nonwoven cloth roll or the like may advantageously be used. After the brushing, the surface is immediately washed with water and dried, whereby the clean surface can be maintained.

Moreover, the surface of the grain oriented silicon steel sheet after the anodic electrolytic treatment in the aqueous halide solution is very active, so that when it is exposed to air, rust is apt to be easily produced. The occurrence of rust degrades not only the appearance but also the adhesion property to the coating and hence brings about the degradation of magnetic properties. In order to prevent the occurrence of rust, therefore, it is effective to add a corrosion preventing agent (inhibitor) to the electrolytic bath. The inhibitor is roughly classified into inorganic substances and organic substances, but the invention may use both substances. As the inorganic inhibitor, mention may be made of chromates, nitrites, phosphates and so on, while as the organic inhibitor, mention may be made of organic sulfur compounds, amines having a polar amino group (—$NH_2$) in its molecule and so on.

The concentration of the inhibitor is different in accordance with the kind of the inhibitor used, but it is usually within a range of about 0.1-50 g/l.

Moreover, when the grain oriented silicon steel sheet is subjected to the anodic electrolytic treatment in the aqueous halide solution, a great amount of $Fe(OH)_2$ precipitate is produced in the bath. If the precipitated amount exceeds about 2%, the viscosity of the solution is too high and normal electrolysis becomes impossible.

Particularly, when using an electrolytic solution consisting mainly of an alkali metal halide, a constant amount of of halogen ion is caught by the precipitate of $Fe(OH)_2$, so that pH of the bath tends to increase. When the pH exceeds 13, a uniform electrolyzed surface can not be obtained. In order to prevent the occurrence of these problems, it is effective to add a pH buffering agent for or a chelating the agent chelating Fe ions. As the pH buffering agent, mention may be made of phosphoric acid, citric acid, boric acid, acetic acid, glycine, maleic acid and so on. As the chelating agent for Fe ions, mention may be made of oxyacids such as citric acid, tartaric acid, glycolic acid and the like; various amines; polyaminocarboxylic acids such as EDTA and the like; polyphosphoric acids and so on. The amount of this agent added is preferably within a range of about 1-100 g/l. And also, in order to prevent the rise of pH in the bath during the electrolysis, it is effective to oxidize the precipitate of $Fe(OH)_2$ into $Fe(OH)_3$. In this case, there are adopted air oxidation forcedly enhancing the contact between the bath and air, the addition of oxide such as $H_2O_2$ or the like to the bath, and the like.

Moreover, according to the invention, it is favorable that prior to the anodic electrolytic treatment the oxide layer produced on the sheet surface through final annealing is removed by subjecting it to a pretreatment to thereby provide a uniform surface. This is because, the presence of the oxide layer is very harmful for promoting the electrolysis reaction when the steel sheet is subjected to the anodic electrolytic treatment and can not achieve the given object of the invention. Although pickling is considered as a means for removing the oxide layer, if the pickling is carried out on the steel sheet, removal of the oxide layer is possible, but the unevenness of the surface increases and consequently the surface smoothening should be carried out for such an uneven surface, so that pickling is not favorable in industry because the thickness of the base metal is required to be several times the usual thickness.

Furthermore, the smoothening through mechanical polishing other than the pickling is considered. However, when the oxide layer is removed from the sheet surface by conventional mechanical polishing with a polishing roll or brush, or by conventional shot blasting, strain is undesirably produced on the surface of the base metal to considerably degrade the magnetic properties of the silicon steel sheet.

Therefore, in the invention, mechanical polishing using an elastic polishing member, which does not cause degradation of the magnetic properties as a drawback of the conventional mechanical polishing, is adopted as a means for removing the oxide layer.

The term "elastic polishing member" used herein means a roll or brush consisting of an elastic substrate having a compressive Young's modulus of not more than $10^4$ kg/cm$^2$ and abrasive grains carried thereon.

In the elastic polishing member, the abrasive grains used are favorable to have a grain size number of not less than #100 (according to JIS R6001). Furthermore, it is advantageous to vertically apply a pressure of not more than 3 kg/cm$^2$ to the steel sheet surface. Such a pressure value can not be attained when using the conventional mechanical polishing.

Moreover, the abrasive grains are not necessarily bonded to the substrate. For instance, these abrasive grains may be dispersed into a polishing liquid as a free abrasive grain.

According to the invention, the effective improvement of the magnetic properties can be attained by subjecting the silicon-containing steel sheet to such a series of the above treatments. Furthermore, the magnetic properties can be much improved by forming a tension applied type coating on the graining pattern surface according to the invention. The tension applied type coating may be the conventionally known phosphate series coating containing collidal silica, or may be formed by a dry or wet plating.

That is, a coating of at least one layer composed of at least one of nitrides and/or carbides of Ti, Nb, Si, V, Cr, Al, Mn, B, Ni, Co, Mo, Zr, Ta, Hf and W and oxides of Al, Si, Mn, Mg, Zn and Ti is strongly adhered to the steel sheet surface by CVD process, PVD process (ion plating, ion implantation or the like), plating or the like.

Moreover, any substances having a low thermal expansion coefficient and strongly bonding to the steel sheet may be used as a material of the above coating in addition to the above coatings. That is, such a substance is sufficient to have a function giving a tension to the steel sheet surface owing to the difference of thermal expansion coefficient. If the layer of this substance is poor in insulating properties, an insulation coating may be further formed as a top coat. Moreover, a tension applied type, low thermal expansion insulation coating may be formed on the steel sheet surface, if necessary.

Figure 1B:
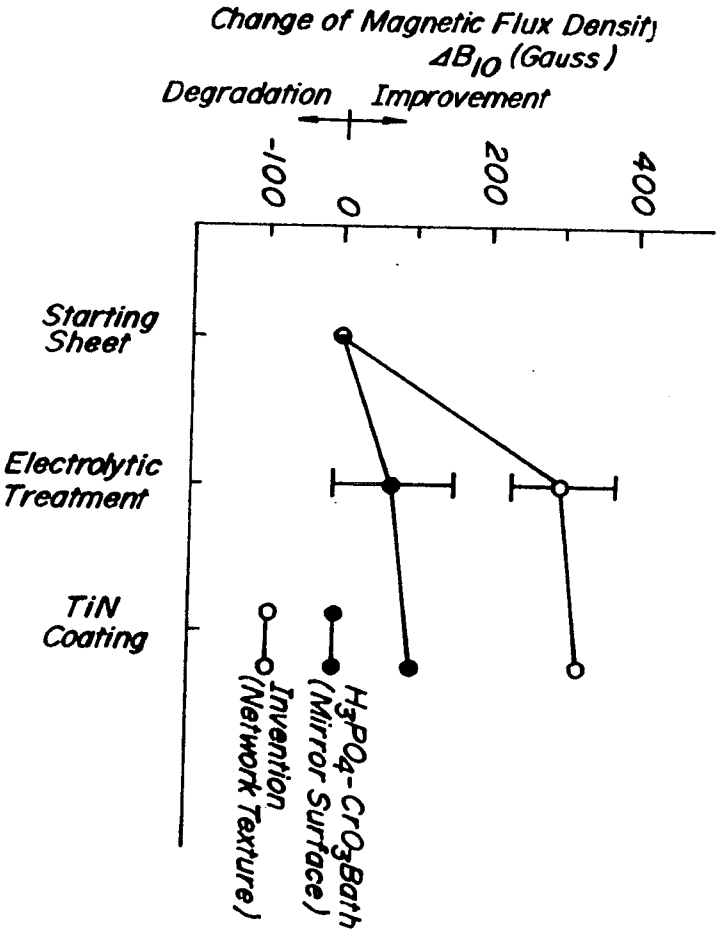
Figure 2:
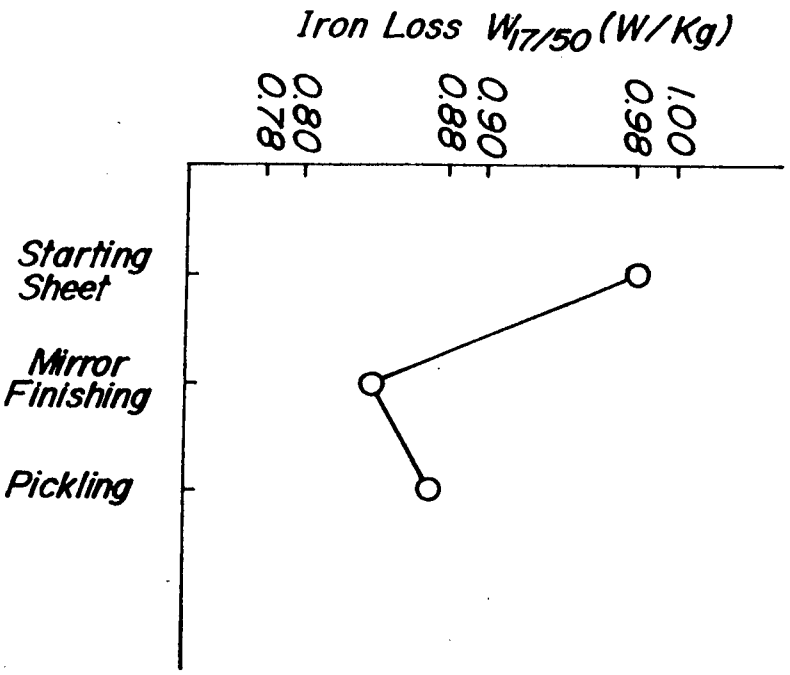
FIG. 2 is a graph showing a comparison of iron loss value when the surface of the grain oriented silicon steel sheet is subjected to a mirror finishing treatment and when the mirror finished surface is subjected to a pickling treatment.
Figure 3:
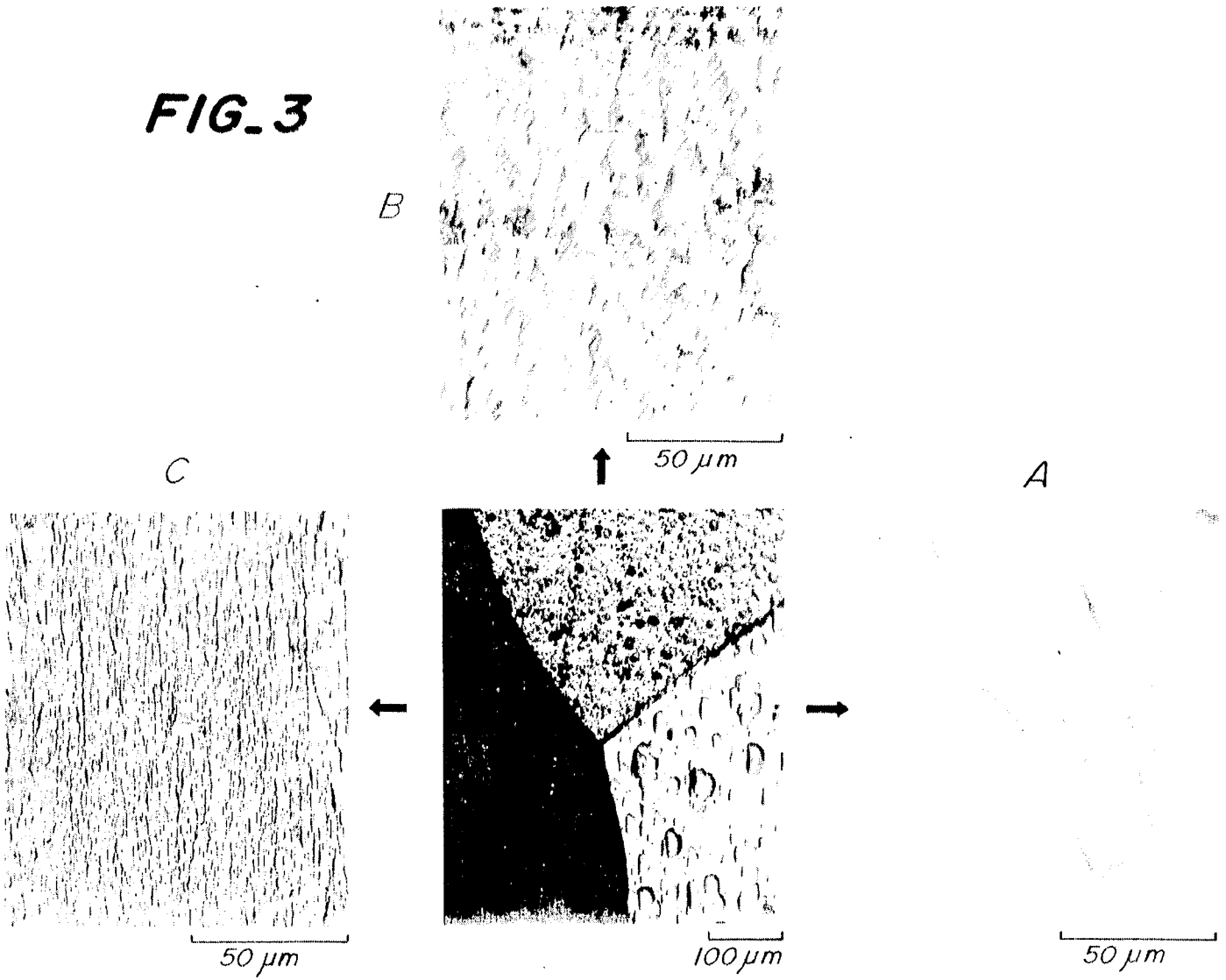
FIG. 3 is a microphotograph of a surface of the grain oriented silicon steel sheet after anodic electrolytic treatment in a chloride bath, wherein A, B and C are enlarged photographs of respective portions, respectively.

In FIG. 1*a* are shown results measured on the improved margin of iron loss after silicon steel sheet mainly consisting of {110} crystal face is subjected to an anodic electrolytic treatment in an aqueous NaCl solution as a water soluble halide. For comparison, the improved margin of iron loss in a grain oriented silicon steel sheet mirror-finished by conventional electrolytic polishing (100 A/dm$^2$, 20 seconds) with a mixed acid ($CrO_3$+10% $H_3PO_4$) is also shown in FIG. 1*a*. Furthermore, the change of magnetic flux density is shown in FIG. 1*b*. As seen from FIGS. 1*a* and 1*b*, the improved margins of the iron loss and the magnetic flux density are large in the treatment using the halide bath as compared with the conventional electrolytic polishing.

Further, when the coercive force Hc before and after the electrolytic treatment is measured in the specimen of fine-grained texture in which the ratio of crystal face existent within 10° from the {110} face is low, Hc lowers by 5% after the electrolytic treatment. In this case, the electrolytic treatment is carried out at a current density of 100 A/dm$^2$ for 10 seconds by using an aqueous 10% NaCl solution.

Moreover, the improved margins when TiN coating is formed on the sheet surface through ion plating are also shown in FIGS. 1*a* and 1*b*, from which the good improvement of iron loss and magnetic flux density is recognized.

Although the improvement of iron loss and magnetic flux density has been confirmed from FIGS. 1*a* and 1*b*, in order to further improve the iron loss and the magnetic flux density, it is necessary that the anodic electrolytic treatment is carried out in the aqueous solution of an halide at a smaller dissolved amount. In this connection, the inventors have made studies with respect to the additives to be added to the aqueous halide solution and found that it is effective to use an electrolytic bath of the halide containing polyether.

Figure 4:
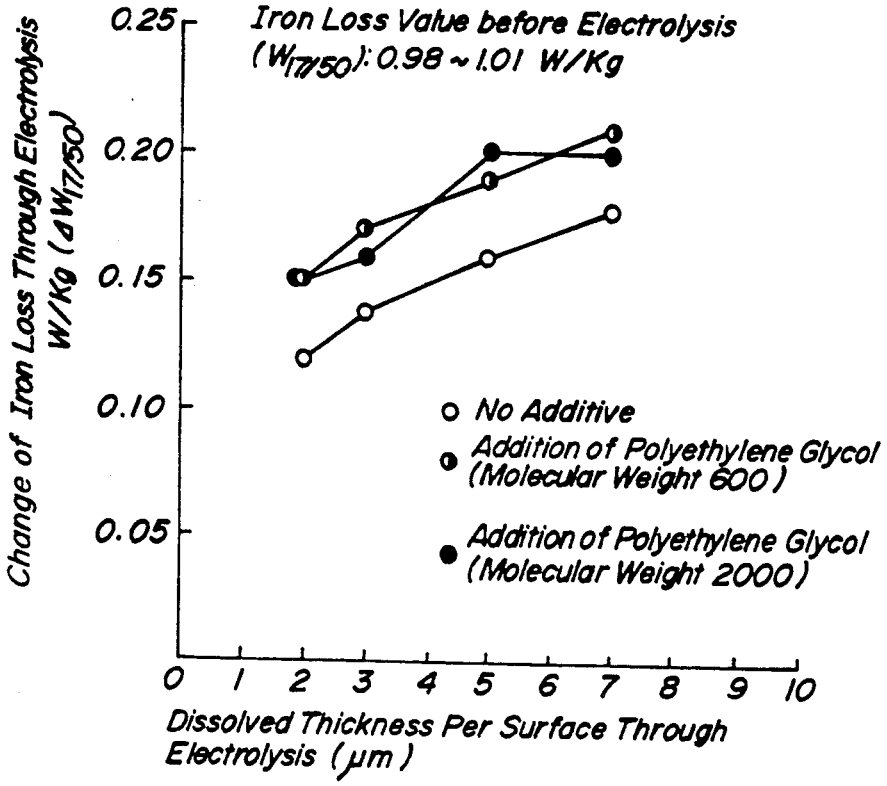
FIG. 4 is a graph showing a dissolved-out thickness of the grain oriented silicon steel sheet and an improved margin of iron loss thereof when the sheet is subjected to an anodic electrolytic treatment in a chloride bath or a polyether containing-chloride bath.

FIG. 4 shows a relation between the dissolved thickness of steel sheet and the change of iron loss ($W_{17/50}$) (i.e. improved amount of iron loss) when the grain oriented silicon steel sheet of 0.23 mm in thickness after the final annealing containing no forsterite coating is subjected to an anodic electrolytic treatment at a current density of 100 A/dm$^2$ in an aqueous solution of 100 g/l NaCl as an electrolytic bath (bath temperature 60° C.). Moreover, the dissolved thickness is changed by varying the electrolytic time. Furthermore, there are used three electrolytic baths, a first one contains no additive, a second one contains 25 g/l of polyethylene glycol having a molecular weight of about 600, and a third one contains 26 g/l of polyethylene glycol having a molecular weight of about 2,000.

As seen from FIG. 4, the dissolved thickness of the steel sheet required for obtaining the same improved amount of iron loss by the addition of polyethylene glycol can be reduced to about ½ that containing no additive. As a result, the reduction of the necessary dissolved thickness brings about industrially large merits such as reduction of power cost, increase of product yield, improvement of productivity, reduction of bath maintenance cost accompanied with reduction in the increase of Fe content in the bath and the like. Moreover, FIG. 4 shows the effect of using polyethylene glycol having a molecular weight of 600 or 2,000, but it has been confirmed that similar results are obtained by using polyethylene glycol with different molecular weight. Therefore, the molecular weight of polyethylene glycol is not particularly restricted in the invention.

Figure 5:
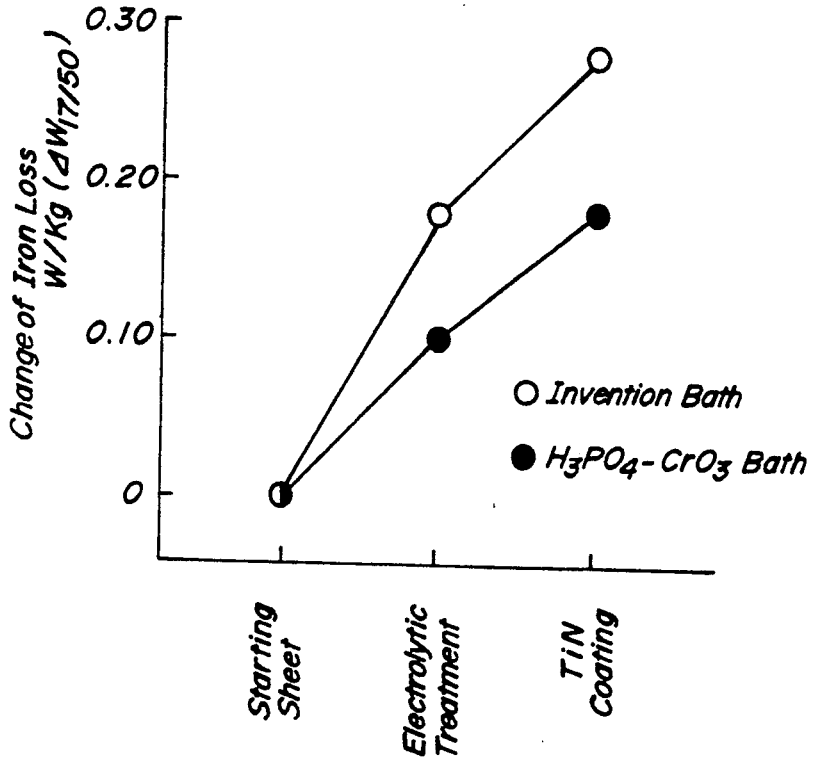
FIG. 5 is a graph showing an improved margin of iron loss when the grain oriented silicon steel sheet is subjected to an anodic electrolytic treatment in a polyether-containing chloride bath or a phosphoric acid-chromic acid bath and when the electrolyzed surface is subjected to a coating of TiN.

As to the improved margin of iron loss in case of using the electrolytic bath of the aqueous halide solution containing polyether, the same experiment as in FIG. 1 was repeated to obtain results as shown in FIG. 5. In this case, the aqueous NaCl solution (concentration 100 g/l) containing 25 g/l of polyethylene glycol with a molecular weight of 600 was used as an electrolytic bath and the electrolytic conditions were 100 $A/dm^2$ and 20 seconds. The other conditions were the same as in the experiment of FIG. 1. Furthermore, the improved margin of iron loss in case of the formation of TiN coating after the electrolytic treatment is also shown in FIG. 5. In any case, the good effect of improving the iron loss is recognized.

Although the mechanism of improving the iron loss by the addition of polyether is not clear, it is considered due to the fact that judging from the fact that the effect is developed irrespective of the molecular weight, the polyether shows any surface activity and promotes the magnetically smoothening of the steel sheet through chlorine ion, which is not dependent upon the mere viscosity rise of the bath or the like.

In the use of the silicon-containing steel sheet, an insulation coating is frequently provided on the sheet surface. Furthermore, in order to further improve the magnetic properties such as magneto-striction, iron loss and the like, tension is applied to the insulation coating, or a double layer of tension coating and insulation coating is formed on the sheet surface. However, the surface of the sheet obtained by conventional mirror finishing as a means for obtaining the magnetically smooth surface is difficult to be subjected to these coatings and is poor in adhesion to the coating.

In this connection, the sheet surface according to the invention not only has a convex portion at the boundary of network grains but also forms a stepwise- or groove-like concave portion in the boundary of the crystal grain, so that it is very excellent in adhesion to the coating.

In the following Table 1 are shown results of adhesion property measured when a phosphate tension coating or a TiN coating through ion plating (thickness: 0.30 mm) is formed on each grain oriented silicon steel sheet obtained by electrolytic polishing in a solution of $H_3PO_4+CrO_3$ (comparative mirror-finished product) and grain oriented silicon steel sheet obtained by electrolytic treatment in NaCl (invention product). Moreover, the adhesion property is evaluated by winding the sheet on a cylinder of 20 mm in diameter as follows: that is, no peeling of the coating is a good adhesion property (100%), while occurrence of local peeling of the coating is a poor adhesion property.

TABLE 1

| | Adhesion property % | |
|---|---|---|
| | phosphate tension coating | TiN |
| Invention product | 100 | 100 |
| Comparative product | 9 | 77 |

As seen from Table 1, according to the invention, the adhesion to the coating is very excellent.

Although the reason why the iron loss of the products according to the invention are low as compared with those of the products obtained by the conventional electrolytic or chemical polishing is not completely elucidated, it is believed that highly geometrical smoothness is not always required for obtaining the magnetically smooth surface and that according to the invention, the grain boundary forms a stepwise- or groove-like concave portion to cause magnetic domain refinement and hence expect the reduction iron loss.

Furthermore, the reason why the adhesion property to the coating is improved by the brushing treatment using a hydrogen carbonate after the electrolytic treatment is due to the fact that the sheet surface is cleaned as previously mentioned. Since the reaction of the equation (3) is caused even on the sheet surface after the electrolytic treatment, amorphous hydrated iron oxide is thinly produced on the whole surface of the sheet and has a loose chemical bond to the base metal, so that it can not be completely removed by the simple brushing treatment. Furthermore, an acid insoluble component called as a smut is also existent on the sheet surface. Moreover, since the grain oriented silicon steel sheet as a starting sheet contains a large amount of Si, it is apt to be easily oxidized and a slight amount of chlorine ion adsorbed on the sheet surface always tends to promote the corrosion of this surface. For these reasons, the surface after the electrolytic treatment is not a complete metallic surface. On the other hand, the cleaning effect of the sheet surface is not obtained only by immersing the steel sheet after the electrolytic treatment in an aqueous solution or suspension of a hydrogen carbonate. As mentioned above, it is difficult to completely remove the surface stain even by a simple brushing treatment with water. Therefore, a means for removing the hydrated iron oxide from the sheet surface is applied during the use of the hydrogen carbonate, whereby the brushing treatment is performed to sufficiently clean the surface.

Figure 6:
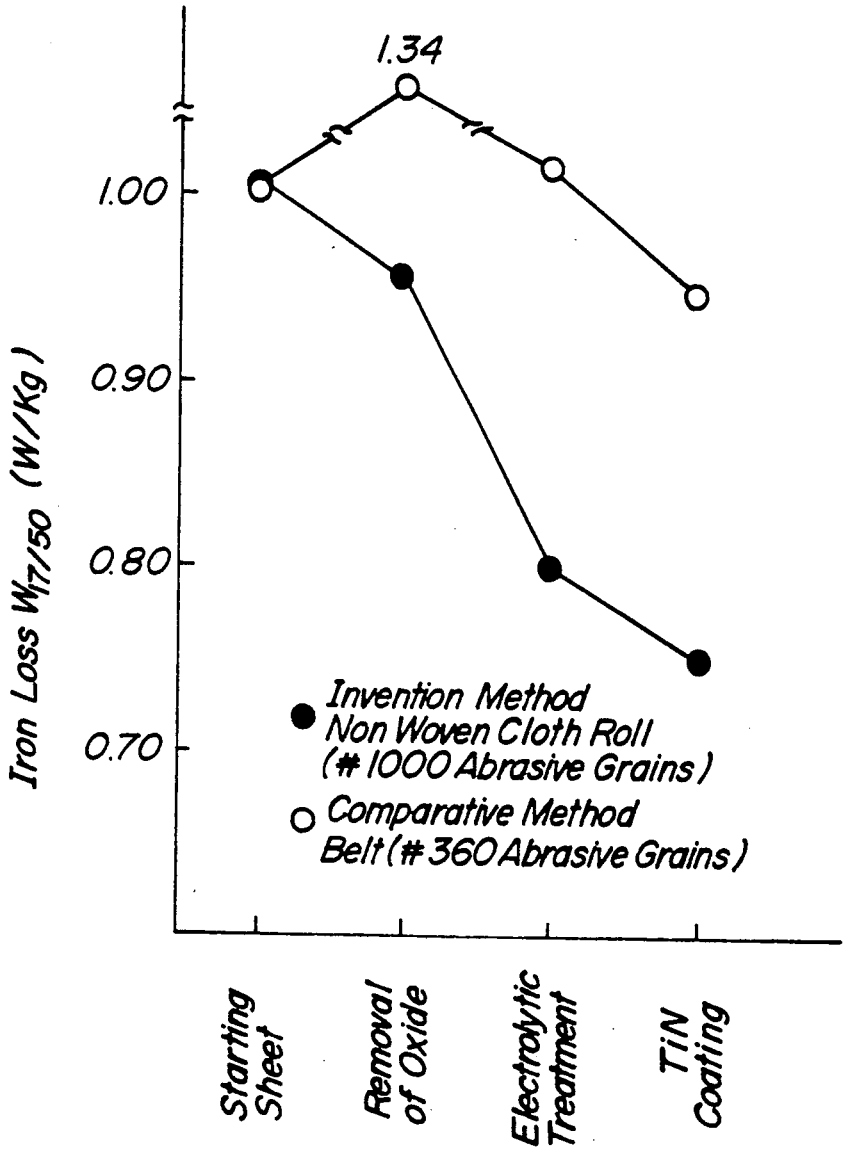
FIG. 6 is a graph showing iron loss values after the grain oriented silicon steel sheet is subjected to a mechanical polishing through a nonwoven cloth or a belt, or after the polished surface is subjected to an electrolytic treatment, and after the electrolyzed surface is subjected to a coating of TiN.

FIG. 6 shows values of iron loss at each stage when the final annealed grain oriented silicon steel sheet is subjected to mechanical polishing with a nonwoven cloth roll at a vertical polishing pressure of not more than 2 $kg/cm^2$ or a belt at a vertical polishing pressure of 6 $kg/cm^2$ using a different grain size of abrasive grains to remove the oxide, subjected to an anodically electrolytic treatment in NaCl solution (dissolved amount 4 $\mu m$; concentration 100 g/l; current density 300 $A/dm^2$), and further provided on the surface with a tension coating of TiN (thickness 1 $\mu m$).

As seen from FIG. 6, there is a great difference in the iron loss after the electrolytic treatment between the use of the nonwoven cloth roll (elastic polishing member) according to the invention and the use of the belt (nonelastic polishing member) as a comparative method.

According to the invention, the sheet is preferably polished at an amount of not less than 0.5 $\mu m$ per surface by the above mechanical polishing.

The following examples are given in illustration of the invention and are not intended as limitations thereof.

EXAMPLE 1

A hot rolled sheet of silicon steel containing C: 0.03%, Si: 3.3%, Mn: 0.06%, Se: 0.02% and Sb: 0.02% was cold rolled to a thickness of 0.23 mm and then subjected to a decarburization annealing. A part of the thus annealed sheet was left as a comparative sheet A, while the remaining sheet was coated with a slurry of an annealing separator consisting essentially of $Al_2O_3$ (containing 0.1% of NaCl), coiled and subjected to a final annealing as a comparative sheet B. A part of the comparative sheet B was rendered into a mirror finished surface by emery and buff polishing as a comparative sheet C, while another part of the comparative sheet B was rendered into a mirror finished surface by the electrolytic polishing in a mixed solution of chromic acid and phosphoric acid (1:9) as a comparative sheet C', and a further part of the comparative sheet B was pickled with sulfuric acid to remove the surface layer by 4 μm as a comparative sheet D.

Further, a part of the sheet B was immersed in an electrolytic solution of NaCl having a concentration of 75% (comparative sheet E), while the remaining portion of the sheet B was immersed in the above electrolytic solution and subjected to an anodically electrolytic treatment at 100 A/dm$^2$ for 10 seconds by using a stainless steel as a cathode (acceptable sheet). Moreover, the comparative sheet A was subjected to the same electrolytic treatment.

The magnetic properties were measured with respect to these sheets. Furthermore, the morphology of the sheet surface was also observed. The measured results are shown below.

Comparative sheet A: Since Hc increases 5% before and after the electrolytic treatment, the magnetically smoothening can not be achieved. Further, the surface morphology is substantially a fine-grained texture (not less than 90%).

Comparative sheet B: The iron loss of the sheet after the final annealing is $W_{17/50}$=0.95 W/kg. As a result of the examination of 30 secondary grains, crystal grains existing within 10° with respect to {110} face are 100%.

Comparative sheet C: The iron loss $W_{17/50}$ of the sheet after the mirror polishing with emery and buff is 1.32 W/kg.

Comparative sheet C': The iron loss after the electrolytic polishing is 0.86 W/kg.

Comparative sheet D: The iron loss is 1.01 W/kg.

Comparative sheet E: The iron loss is 0.97 W/kg.

Acceptable sheet: The iron loss is 0.80 W/kg and the texture is a network pattern (graining pattern).

Then, TiN of 1 μm in thickness was deposited on each of the comparative sheets B, C, C', D and acceptable sheet through ion plating to obtain the following results:

| | Sheet B | Sheet C | Sheet C' | Sheet D | Acceptable sheet |
|---|---|---|---|---|---|
| $W_{17/50}$ (W/kg) | 0.87 | 1.00 | 0.76 | 0.93 | 0.69 |

As to the adhesion property, the acceptable sheet and the comparative sheets B and D were good, but the peeling was observed in the comparative sheets C and C' according to the bending test of 20 mmϕ.

EXAMPLE 2

A hot rolled sheet of silicon steel containing C: 0.03%, Si: 3.2%, Mn: 0.08%, S: 0.02% and Al: 0.02% was cold rolled to a thickness of 0.30 mm, subjected to a decarburization annealing, coated with an annealing separator of MgO and subjected to a final annealing. The iron loss $W_{17/50}$ after the final annealing was 1.02 W/kg. Further, when 30 crystal grains were measured through an X-ray, the displacement of orientation from {110} face was not more than 10°. After the forsterite coating was removed from the surface of the final annealed sheet by pickling, the sheet was subjected to an anodically electrolytic treatment in a 100% solution of $NH_4Cl$ by using the sheet as an anode under conditions of 50 A/dm$^2$ and 2,000 coulomb/dm$^2$, whereby the sheet having a beautiful graining surface texture and an iron loss $W_{17/50}$ of 0.83 W/kg was obtained.

Further, when $Si_3N_4$ coating (thickness 1 μm) was formed through ion plating, the iron loss $W_{17/50}$ reduced to 0.71 W/kg. Moreover, the adhesion property to the coating was good.

EXAMPLE 3

A hot rolled sheet of steel containing C: 0.043%, Si: 3.35%, Se: 0.018%, Mo: 0.013% and Sb: 0.025% was subjected to two-times cold rolling through an intermediate annealing to a thickness of 0.23 mm. Then, the cold rolled steel sheet was subjected to decarburization and primary recrystallization annealing in a wet hydrogen atmosphere at 830°C., coated with a slurry of an annealing separator consisting essentially of MgO and $AL_2O_3$, coiled and subjected to final annealing.

After oxide coating was removed from the surface of the test sheet by pickling, the test sheet was subjected to an electrolysis in an aqueous solution of a chloride shown in the following Table 2 and then the iron loss ($W_{17/50}$) was measured. For the comparison, there were conducted a mirror polishing process using phosphoric acid and chromic acid (Comparative Example 14), a mirror polishing process using only phosphoric acid (Comparative Example 15) and a mechanical polishing process (emery #1000 finish: Comparative Example 16). As is well-known, the process using phosphoric acid and chromic acid exhibits a large improvement of iron loss, which is not still better than that of the invention. Furthermore, the mirror finished surface using phosphoric acid is fairly poor in the iron loss as compared with that of the invention. On the other hand, the iron loss is rather degraded by the mechanical polishing process.

After a tension coating of TiN was formed on the surface of each of these sheets through ion plating, the bending adhesion test using a rod of 20 mm in diameter was carried out, and consequently the acceptable examples No. 1–13 were good (100% no peeling), the acceptable example No. 14 was slightly poor (20% peeling), and the comparative examples No 15 and 16 were poor (No. 15 80% peeling, No. 16 100% peeling)

The measured results are shown in Table 2.

TABLE 2

| | Electrolytic bath | | Bath | Electrolytic conditions | | Dissolved | Iron | |
|---|---|---|---|---|---|---|---|---|
| No. | component | concentration (g/l) | temperature (°C.) | current density (A/dm$^2$) | quantity of electricity (coulomb/dm$^2$) | thickness per surface (μm) *1 | loss $W_{17/50}$ (W/kg) *2 | Remarks |
| 1 | NaCl | 75 | 50 | 100 | 2000 | 5 | 0.82 | Acceptable Example |
| 2 | NaCl | 150 | 20 | 25 | 1200 | 3 | 0.84 | |
| 3 | NaCl | 300 | 70 | 200 | 3200 | 8 | 0.80 | |
| 4 | NaCl | 500 | 70 | 150 | 3000 | 7 | 0.79 | |

TABLE 2-continued

| No. | Electrolytic bath component | Electrolytic bath concentration (g/l) | Bath temperature (°C.) | Electrolytic conditions current density ($A/dm^2$) | Electrolytic conditions quantity of electricity ($coulomb/dm^2$) | Dissolved thickness per surface (μm) *1 | Iron loss $W_{17/50}$ (W/kg) *2 | Remarks |
|---|---|---|---|---|---|---|---|---|
| 5 | KCl | 50 | 60 | 50 | 800 | 2 | 0.86 | |
| 6 | KCl | 200 | 40 | 150 | 2400 | 6 | 0.81 | |
| 7 | $NH_4Cl$ | 100 | 60 | 30 | 2800 | 7 | 0.81 | |
| 8 | $NH_4Cl$ | 200 | 30 | 150 | 1600 | 4 | 0.83 | |
| 9 | $MgCl_2$ | 100 | 80 | 50 | 800 | 2 | 0.85 | |
| 10 | $MgCl_2$ | 100 | 50 | 100 | 2000 | 5 | 0.82 | |
| 11 | HCl<br>NaCl | 30<br>100 | 60 | 100 | 2000 | 5 | 0.81 | Acceptable |
| 12 | $NH_4Cl$<br>$CaCl_2$ | 100<br>50 | 60 | 100 | 2000 | 5 | 0.82 | Example |
| 13 | KCl<br>$NH_4Cl$ | 100<br>100 | 60 | 100 | 2000 | 5 | 0.82 | |
| 14 | $H_3PO_4$<br>$CrO_3$ | 85% 1 l<br>300 | 80 | 100 | 2000 | 5 | 0.88 | Comparative |
| 15 | $H_3PO_4$ | 85% | 80 | 100 | 2000 | 5 | 0.94 | Example |
| 16 | Emery polishing | — | — | — | — | 3 | 1.24 | |

*1 calculated from the weight difference before and after the electrolysis treatment
*2 Iron loss before electrolysis treatment: 0.98 W/kg As seen from Table 2, the improvement of iron loss is large in all acceptable examples according to the invention. On the contrary, in the comparative examples treated outside the conditions of the invention, the electrolytic treating effect is small, and the improvement of iron loss is slight.

EXAMPLE 4

A hot rolled sheet of steel containing C: 0.059%, Si: 3.35%, Mn: 0.077%, Al: 0.024%, S: 0.023%, Cu: 0.1% and Sn: 0.015% was subjected to two-time cold rolling through an intermediate annealing to a thickness of 0.23 mm. Then, the cold rolled sheet was subjected to decarburization and primary recrystallization annealing in a wet hydrogen atmosphere at 840° C., coated with a slurry of an annealing separator consisting essentially of $Al_2O_3$ and MgO, coiled, subjected to a final annealing. Thereafter, the unreacted annealing separator was removed and the sheet was subjected to a flat annealing to correct the curling of the coil, whereby a test sheet was prepared. After the oxide coating was removed from the surface of the test sheet by pickling, the sheet was subjected to an electrolysis treatment in an aqueous solution of a chloride shown in the following Table 3, and then the iron loss ($W_{17/50}$) was measured. The measured results are shown in Table 3.

No. 21 is a comparative example showing a case that the surface was rendered into a mirror state by the electrolytic polishing with phosphoric acid and chromic acid, wherein the iron loss is fairly poor as compared with that of the invention And also, No. 22 is a comparative example showing the mirror electrolytic polishing with phosphoric acid and is very narrow in the improved margin of iron loss

TABLE 3

| No. | Electrolytic bath component | Electrolytic bath concentration (g/l) | Bath temperature (°C.) | Electrolytic conditions current density ($A/dm^2$) | Electrolytic conditions quantity of electricity ($coulomb/dm^2$) | Dissolved thickness per surface (μm) *1 | Iron loss $W_{17/50}$ (W/kg) *2 | Remarks |
|---|---|---|---|---|---|---|---|---|
| 17 | NaCl | 150 | 50 | 100 | 2000 | 5 | 0.81 | Acceptable |
| 18 | $NH_4Cl$ | 200 | 30 | 150 | 1600 | 4 | 0.82 | |
| 19 | $MgCl_2$ | 100 | 80 | 50 | 800 | 2 | 0.84 | Example |
| 20 | HCl<br>NaCl | 30<br>100 | 60 | 100 | 2000 | 5 | 0.81 | |
| 21 | $H_3PO_4$<br>$CrO_3$ | 85% 1 l<br>300 | 80 | 100 | 2000 | 5 | 0.89 | Comparative |
| 22 | $H_3PO_4$ | 85% | 80 | 100 | 2000 | 5 | 0.96 | Example |

*1, *2 same in Table 2

EXAMPLE 5

The same test sheet as in Example 3 was provided, which was pickled to remove the oxide coating from the surface of the sheet and subjected to an electrolytic treatment in an aqueous solution of a chloride containing polyethylene glycol as shown in the following Table 4, and then the iron loss ($W_{17/50}$) Was measured. For the comparison, the electrolytic polishing with phosphoric acid and chromic acid was also performed. The measured results of iron loss are also shown in Table 4.

TABLE 4

| No. | Electrolytic bath chloride composition | Electrolytic bath chloride concentration (g/l) | Electrolytic bath polyethylene glycol molecular weight | Electrolytic bath polyethylene glycol concentration (g/l) | Bath temperature (°C.) | Electrolytic conditions current density ($A/dm^2$) | Electrolytic conditions quantity of electricity ($coulomb/dm^2$) | Dissolved thickness per surface (μm) *1 | Iron loss $W_{17/50}$ (W/kg) *2 | Remarks |
|---|---|---|---|---|---|---|---|---|---|---|
| 1 | NaCl | 250 | 600 | 10 | 50 | 100 | 2000 | 5 | 0.80 | Accept- |

TABLE 4-continued

| No. | Electrolytic bath: chloride composition | chloride concentration (g/l) | polyethylene glycol molecular weight | polyethylene glycol concentration (g/l) | Bath temperature (°C.) | Electrolytic conditions: current density (A/dm²) | Electrolytic conditions: quantity of electricity (coulomb/dm²) | Dissolved thickness per surface (μm) *1 | Iron loss $W_{17/50}$ (W/kg) *2 | Remarks |
|---|---|---|---|---|---|---|---|---|---|---|
| 2 | NaCl | " | " | 30 | " | " | " | " | 0.81 | able |
| 3 | NaCl | " | " | 80 | " | " | " | " | 0.81 | Example |
| 4 | KCl | 200 | 2000 | 50 | 60 | " | " | " | 0.82 | |
| 5 | $NH_4Cl$ | 150 | " | " | " | " | " | " | 0.81 | |
| 6 | $NH_4Cl$ | " | 6000 | 20 | " | " | " | " | 0.79 | |
| 7 | $MgCl_2$ | 100 | 300 | 40 | " | " | " | " | 0.80 | |
| 8 | $MgCl_2$ | " | 1000 | " | " | " | " | " | 0.79 | |
| 9 | NaCl<br>$NH_4Cl$ | 100<br>100 | 1500 | 10 | 40 | " | " | " | 0.82 | |
| 10 | NaCl<br>$NH_4Cl$ | 100<br>100 | 1500 | 25 | 40 | 100 | 2000 | 5 | 0.80 | Acceptable |
| 11 | NaCl<br>$NH_4Cl$ | 100<br>100 | " | 50 | " | " | " | " | 0.81 | Example |
| 12 | HCl<br>NaCl | 10<br>150 | 400 | 20 | 30 | " | " | " | 0.79 | |
| 13 | HCl<br>NaCl | 10<br>150 | 4000 | 60 | " | " | " | " | 0.80 | |
| 14 | 85% $H_3PO_4$ (1 l) + $CrO_3$ (200 g) | | | | 60 | " | 3000 | " | 0.88 | Comparative Example |

*1 same in Table 2
*2 Iron loss before electrolysis treatment: 0.99 W/kg

As seen from Table 4, the products according to the invention is large in the improved margin of iron loss as compared with the product obtained by the conventionally known electrolytic polishing with phosphoric acid and chromic acid.

Furthermore, when each of these sheets was provided on its surface with a tension coating of TiN through ion plating and subjected to a bending adhesion test using a rod of 20 mm in diameter, the acceptable examples No. 1-13 according to the invention were good (no peeling) in the adhesion property, while the comparative No. 14 was poor.

EXAMPLE 6

The same test sheet as in Example 4 was provided, which was pickled to remove the oxide coating from the surface of the sheet and subjected to an electrolytic treatment in an aqueous solution of a chloride as shown in the following Table 5, and then the iron loss ($W_{17/50}$) was measured. The measured results are also shown in Table 5. Moreover, No. 9 is a comparative example of mirror finishing by electrolytic polishing with phosphoric acid and chromic acid.

TABLE 5

| No. | Electrolytic bath: chloride composition | chloride concentration (g/l) | polyethylene glycol molecular weight | polyethylene glycol concentration (g/l) | Bath temperature (°C.) | Electrolytic conditions: current density (A/dm²) | Electrolytic conditions: quantity of electricity (coulomb/dm²) | Dissolved thickness per surface (μm) *1 | Iron loss $W_{17/50}$ (W/kg) *2 | Remarks |
|---|---|---|---|---|---|---|---|---|---|---|
| 1 | NaCl | 250 | 600 | 10 | 50 | 100 | 2000 | 5 | 0.78 | Acceptable |
| 2 | NaCl | " | " | 80 | " | " | " | " | 0.79 | Example |
| 3 | KCl | 200 | 2000 | 50 | 60 | " | " | " | 0.80 | |
| 4 | $NH_4Cl$ | 150 | 6000 | 20 | " | " | " | " | 0.78 | |
| 5 | $MgCl_2$ | 100 | 300 | 40 | " | " | " | " | 0.81 | |
| 6 | $MgCl_2$ | " | 1000 | " | " | " | " | " | 0.80 | |
| 7 | NaCl<br>$NH_4Cl$ | 100<br>100 | 1500 | 10 | 40 | " | " | " | 0.80 | |
| 8 | NaCl<br>$NH_4Cl$ | 100<br>100 | " | 50 | " | " | " | " | 0.79 | |
| 9 | 85% $H_3PO_4$ (1 l) + $CrO_3$ (200 g) | | | | " | " | 3000 | " | 0.88 | Comparative Example |

*1, *2 same in Table 2

As seen from Table 5, the iron loss value in the acceptable examples No. 1-8 according to the invention is considerably low as compared with the comparative No. 9.

EXAMPLE 7

The same test sheet as in Example 3 was provided, which was pickled to remove the oxide coating from the surface of the sheet and then subjected to an anodically electrolytic treatment in an aqueous solution of a chloride as shown in the following Table 6. Thereafter, the sheet was washed with water and then subjected to a brushing treatment with a nylon brushing roll while applying an aqueous solution or suspension of a hydrogen carbonate to the sheet. Then, the sheet was washed with water, dried, subjected to a coating as shown in Table 6, and then subjected to a strain relief annealing at 800° C. for 3 hours. The magnetic properties and adhesion property of the thus obtained product were evaluated to obtain results as shown in Table 6. For the comparison, the same measurement was carried out in case of conducting no brushing treatment (No. 8), conducting the brushing with water (No. 9), or conducting the electrolytic polishing with phosphoric acid and chromic acid (No. 10) to obtain results as shown in Table 6. In the acceptable examples according to the invention, the adhesion property is excellent and the iron loss value is good, while in the comparative No. 8 and 9 conducting no brushing treatment with the hydrogen carbonate, the adhesion property is poor and the magnetic properties are slightly poor, and in case of the electrolytic polishing with phosphoric acid and chromic acid (No. 10), the adhesion property and the magnetic properties are much poor.

Thereafter, the sheet was washed with water and subjected to a brushing treatment with a nylon brushing roll while applying an aqueous solution or suspension of a hydrogen carbonate to the sheet. Then, the sheet was washed with water, dried, subjected to a coating as shown in Table 7 and further to a strain relief annealing at 800° C. for 3 hours. The magnetic properties and adhesion property of the thus obtained product were evaluated to obtain results as shown in Table 7. For the comparison, the same measurement was carried out in case of conducting no brushing treatment (No. 8), conducting the brushing with water (No. 9), or conducting the chemical polishing with a mixed solution of $H_2O_2$ and HF (No. 10) to obtain results as shown in Table 7.

In the acceptable examples according to the invention, the adhesion property is excellent and the iron loss value is good, while in the comparative No. 8 and 9 conducting no brushing treatment with the hydrogen carbonate, the adhesion property is poor and the magnetic properties are slightly poor, and in case of the chemical polishing with a mixed solution of $H_2O_2$ and HF (No. 10), the adhesion property and the magnetic properties are much poor.

TABLE 6

| | Electrolysis in aqueous chloride solution | | | | | |
|---|---|---|---|---|---|---|
| | bath | | bath | electrolytic conditions | | dissolved thickness |
| No. | composition | concentration (g/l) | temperature (°C.) | current density ($A/dm^2$) | quantity of electricity ($coulomb/dm^2$) | per surface (μm) *1 |
| 1 | NaCl | 200 | 60 | 80 | 2000 | 5 |
| 2 | NaCl | " | " | " | " | " |
| 3 | NaCl | " | " | " | " | " |
| 4 | $MgCl_2$ | 150 | " | 100 | 1600 | 4 |
| 5 | $MgCl_2$ | " | " | " | " | " |
| 6 | $NH_4Cl$<br>KCl | 100<br>100 | 50 | 70 | 2800 | 7 |
| 7 | $NH_4Cl$<br>KCl | "<br>" | " | " | " | " |
| 8 | NaCl | 200 | 60 | 100 | 1600 | 4 |
| 9 | $NH_4Cl$<br>KCl | 100<br>100 | 50 | 70 | 2800 | 7 |
| 10 | 85% $H_3PO_4$ (1 l)<br>$CrO_3$ (200 g) | | 80 | 80 | 3000 | 5 |

| | Brushing | | Coating | | | Evaluation *3 | | |
|---|---|---|---|---|---|---|---|---|
| No. | liquid | concentration (g/l) | composition | coating formation | thickness (μm) | Iron loss $W_{17/50}$ (W/kg) | adhesion property to coating *4 | Remarks |
| 1 | $NaHCO_3$ slurry | 150 | TiN | PVD | 1.0 | 0.68 | 20 | Acceptable |
| 2 | $NaHCO_3$ aqueous solution | 50 | " | " | 0.5 | 0.70 | 20 | Example |
| 3 | $NaHCO_3$ aqueous solution | " | $Mg(H_2PO_4)_2$<br>colloidal silica<br>$CrO_3$ | roll coat | 0.5 | 0.73 | 25 | |
| 4 | $NaHCO_3$ aqueous solution | 30 | SiN | PVD | 0.5 | 0.71 | 20 | |
| 5 | $NH_4HCO_3$ slurry | 200 | $Mg(H_2PO_4)_2$<br>colloidal silica<br>$CrO_3$ | roll coat | 0.5 | 0.72 | 25 | |
| 6 | $NH_4HCO_3$ slurry | 300 | TiN | PVD | 0.8 | 0.69 | 20 | |
| 7 | $NH_4HCO_3$ aqueous solution | 50 | SiN | " | 0.3 | 0.72 | 15 | |
| 8 | no brushing | " | TiN | " | 1.0 | 0.76 | 50 | Comparative |
| 9 | water | " | SiN | " | 0.3 | 0.75 | 40 | Example |
| 10 | no brushing | " | $Mg(H_2PO_4)_2$<br>colloidal silica<br>$CrO_3$ | roll coat | 0.3 | 0.83 | 50< | |

*1 same in Table 2
*3 after strain-relief annealing in $N_2$ atmosphere at 800° C. for 3 hours
*4 minimum size causing no peeling of coating, mm

EXAMPLE 8

The same test sheet as in Example 4 was provided, which was pickled to remove the oxide coating from the surface of the sheet and then subjected to an anodically electrolytic treatment in an aqueous solution of a chloride as shown in the following Table 7.

TABLE 7

| | Electrolysis in aqueous chloride solution | | | | | |
|---|---|---|---|---|---|---|
| | bath | | bath | electrolytic conditions | | dissolved |
| No. | component | concentration (g/l) | temperature (°C.) | current density ($A/dm^2$) | quantity of electricity ($coulomb/dm^2$) | thickness per surface (μm) *1 |
| 1 | $NH_4Cl$ | 200 | 40 | 50 | 2800 | 7 |
| 2 | $NH_4Cl$ | " | " | " | " | " |
| 3 | KCl | 250 | 60 | 100 | 2000 | 5 |
| 4 | KCl | " | " | " | " | " |
| 5 | NaCl | 150 | " | " | " | " |
| 6 | $MgCl_2$<br>$NH_4Cl$ | 100<br>100 | 50 | 70 | 2400 | 6 |
| 7 | $MgCl_2$<br>$NH_4Cl$ | "<br>" | " | " | " | " |
| 8 | KCl | 250 | 60 | 100 | 2000 | 5 |
| 9 | $MgCl_2$<br>$NH_4Cl$ | 100<br>100 | 50 | 70 | 2400 | 6 |
| 10 | 30% $H_2O_2$, 1.5 l<br>46% HF, 0.05 l | | 20 | immersion for 200 sec (chemical polishing) | | 5 |

| | Brushing | | Coating | | | Evaluation *3 | | |
|---|---|---|---|---|---|---|---|---|
| No. | liquid | concentration (g/l) | composition | coating formation | thickness (μm) | Iron loss $W_{17/50}$ (W/kg) | adhesion property to coating *4 | Remarks |
| 1 | $NaHCO_3$ aqueous solution | saturation | TiN | PVD | 0.5 | 0.67 | 15 | Acceptable Example |
| 2 | $NaHCO_3$ aqueous solution | saturation | SiN | " | 0.5 | 0.69 | 15 | |
| 3 | $NaHCO_3$ aqueous solution | 50 | TiN | " | 1.0 | 0.71 | 20 | |
| 4 | $NaHCO_3$ slurry | 150 | $Mg(H_2PO_4)_2$<br>colloidal silica<br>$CrO_3$ | roll coat | 0.5 | 0.73 | 25 | |
| 5 | $NaHCO_3$ slurry | " | SiN | PVD | 0.7 | 0.71 | 20 | |
| 6 | $KHCO_3$ aqueous solution | 30 | $Mg(H_2PO_4)_2$<br>colloidal silica<br>$CrO_3$ | roll coat | 0.7 | 0.72 | 25 | |
| 7 | $KHCO_3$ slurry | 300 | TiN | PVD | 1.0 | 0.70 | 20 | |
| 8 | no brushing | — | " | " | 1.0 | 0.75 | 45 | Comparative Example |
| 9 | water | — | " | " | 1.0 | 0.74 | 40 | |
| 10 | no brushing | — | $Mg(H_2PO_4)_2$<br>colloidal silica<br>$CrO_3$ | roll coat | 0.5 | 0.82 | 50< | |

*1 same in Table
*3, *4 same in Table 6

EXAMPLE 9

The same test sheets as in Examples 3 and 4 were provided, which were pickled to remove the oxide coating from the surface of the sheet and subjected to an anodically electrolytic treatment in an aqueous solution of a chloride containing polyethylene glycol as shown in the following Table 8. Thereafter, the sheets were washed with water and subjected to a brushing treatment with a nylon brushing roll while applying an aqueous solution or suspension of a hydrogen carbonate. Then, the sheets were washed with water, dried, subjected to a coating as shown in Table 8 and further to a strain relief annealing at 800° C. for 3 hours. The magnetic properties and adhesion property of the thus obtained product were evaluated to obtain results as shown in Table 8. For the comparison, the same measurement was carried out in case of conducting the brushing treatment only with water (Nos. 9 and 10) or conducting the electrolytic polishing with phosphoric acid and chromic acid (Nos. 11 and 12) to obtain results as shown in Table 8. In the acceptable examples according to the invention, the adhesion property is excellent and the iron loss value is good, while in the comparative Nos. 9 and 10 conducting no brushing treatment with the hydrogen carbonate, the adhesion property is poor and the magnetic properties are slightly poor, and in case of the electrolytic polishing with phosphoric acid and chromic acid (Nos. 11 and 12), the adhesion property and the magnetic properties are much poor.

TABLE 8

| | | Electrolytic bath | | | | Electrolytic conditions | | | |
|---|---|---|---|---|---|---|---|---|---|
| | | chloride | | polyethylene glycol | | bath | | | dissolved |
| No. | Starting sheet *5 | component | concentration (g/l) | molecular weight | concentration (g/l) | temperature (°C.) | current density ($A/dm^2$) | quantity of electricity ($coulomb/dm^2$) | thickness per surface (μm) *1 |
| 1 | 1 | NaCl | 250 | 600 | 30 | 50 | 100 | 2000 | 5 |

TABLE 8-continued

| | | | | | | | | | |
|---|---|---|---|---|---|---|---|---|---|
| 2 | " | KCl | 200 | 2000 | 50 | 60 | " | " | " |
| 3 | " | $MgCl_2$ | 100 | 300 | 40 | " | " | " | " |
| 4 | " | NaCl | 100 | 1500 | 25 | 40 | " | " | " |
| | | $NH_4Cl$ | 100 | | | | | | |
| 5 | 2 | NaCl | 250 | 600 | 10 | 50 | " | " | " |
| 6 | " | $NH_4Cl$ | 150 | 6000 | 20 | 60 | " | " | " |
| 7 | " | $MgCl_2$ | 100 | 1000 | 40 | " | " | " | " |
| 8 | " | NaCl | 100 | 1500 | 50 | 40 | " | " | " |
| | | $NH_4Cl$ | 100 | | | | | | |
| 9 | 1 | NaCl | 250 | 600 | 30 | 50 | " | " | " |
| 10 | 2 | $MgCl_2$ | 100 | 1000 | 40 | 60 | " | " | " |
| 11 | 1 | 85% $H_3PO_4$ (1 l) $CrO_3$ (200 g) | | | | 80 | 80 | 3000 | " |
| 12 | 2 | 85% $H_3PO_4$ (1 l) $CrO_3$ (200 g) | | | | " | " | " | " |

| | Brushing | | Coating | | | Evaluation *3 | | |
|---|---|---|---|---|---|---|---|---|
| No. | liquid | concentration (g/l) | composition | coating formation | thickness (μm) | Iron loss $W_{17/50}$ (W/kg) | adhesion property to coating *4 | Remarks |
| 1 | $NaHCO_3$ slurry | 150 | TiN | PVD | 1.0 | 0.68 | 20 | Acceptable |
| 2 | $NaHCO_3$ slurry | " | " | " | 0.5 | 0.70 | 15 | Example |
| 3 | $NaHCO_3$ aqueous solution | 50 | SiN | " | 0.5 | 0.71 | 15 | |
| 4 | $NaHCO_3$ aqueous solution | " | $Mg(H_2PO_4)_2$ colloidal silica $CrO_3$ | roll coat | 0.8 | 0.71 | 25 | |
| 5 | $NaHCO_3$ slurry | 150 | TiN | PVD | 0.7 | 0.69 | 15 | |
| 6 | $NaHCO_3$ | " | " | " | 0.7 | 0.70 | 20 | |
| 7 | $NaHCO_3$ aqueous solution | 50 | SiN | " | 0.5 | 0.71 | 15 | |
| 8 | $NaHCO_3$ aqueous solution | " | $Mg(H_2PO_4)_2$ colloidal silica $CrO_3$ | roll coat | 0.8 | 0.70 | 25 | |
| 9 | water | — | TiN | PVD | 1.0 | 0.75 | 45 | Comparative |
| 10 | " | — | SiN | " | 0.5 | 0.76 | 45 | |
| 11 | no brushing | | $Mg(H_2PO_4)_2$ colloidal silica $CrO_3$ | roll coat | 0.3 | 0.83 | 50< | Example |
| 12 | water | — colloidal silica $CrO_3$ | $Mg(H_2PO_4)_2$ | roll coat | 0.3 | 0.84 | 50< | |

*1 same in Table 2
*3, *4 same in Table 6
*5 Starting sheet: 1 . . . same in Example 1 2 . . . same in Example 2

EXAMPLE 10

The same test sheet as in Example 3 was provided, which was pickled to remove the oxide coating from the surface of the sheet and then subjected to an anodically electrolytic treatment in an aqueous solution of a halide as shown in the following Table 9, and thereafter the iron loss ($W_{17/50}$) was measured.

For the comparison, the electrolytic polishing with phosphoric acid and chromic acid (No. 9) was carried out to obtain a result of iron loss as shown in Table 9.

TABLE 9

| | Electrolytic bath | | Bath | Electrolytic conditions | | Dissolved | Iron | |
|---|---|---|---|---|---|---|---|---|
| No. | component | concentration (g/l) | temperature (°C.) | current density ($A/dm^2$) | quantity of electricity ($coulomb/dm^2$) | thickness per surface (μm) *1 | loss $W_{17/50}$ (W/kg) *2 | Remarks |
| 1 | $NH_4F$ | 50 | 40 | 70 | 3000 | 7 | 0.82 | Acceptable |
| 2 | KBr | 100 | 60 | 70 | 2500 | 6 | 0.83 | |
| 3 | NaI | 70 | 60 | 50 | 3000 | 7 | 0.83 | Example |
| 4 | NaCl | 100 | 50 | 100 | 2000 | 5 | 0.81 | |
| | $(NH_4)_2SiF_6$ | 20 | | | | | | |
| 5 | KBr | 50 | 50 | 100 | 2000 | 5 | 0.83 | |
| | $NaBF_4$ | 30 | | | | | | |
| 6 | NaCl | 150 | 60 | 80 | 2000 | 5 | 0.82 | |
| | NaI | 30 | | | | | | |
| 7 | NaF | 50 | 50 | 60 | 2500 | 6 | 0.82 | |
| | KI | 50 | | | | | | |
| 8 | $NH_4Cl$ | 100 | 40 | 70 | 3000 | 7 | 0.79 | |
| | KBr | 20 | | | | | | |
| 9 | $H_3PO_4$ | 85% 1 l | 60 | 100 | 3000 | 5 | 0.88 | Comparative |
| | $CrO_3$ | 200 | | | | | | |

TABLE 9-continued

| No. | Electrolytic bath component | Electrolytic bath concentration (g/l) | Bath temperature (°C.) | Electrolytic conditions current density ($A/dm^2$) | Electrolytic conditions quantity of electricity ($coulomb/dm^2$) | Dissolved thickness per surface (μm) *1 | Iron loss $W_{17/50}$ (W/kg) *2 | Remarks |
|---|---|---|---|---|---|---|---|---|
| | | | | | | | | Example |

*1, *2 same in Table 2

As seen from Table 9, the improved margin of iron loss is large in the acceptable examples according to the invention as compared with that of the comparative example.

EXAMPLE 11

The same test sheet as in Example 3 was provided, which was pickled to remove the oxide coating from the surface of the sheet and then subjected to an anodically electrolytic treatment in an aqueous solution of a halide containing polyethylene glycol as shown in the following Table 10, and thereafter the iron loss ($W_{17/50}$) was measured. For the comparison, the electrolytic polishing with phosphoric acid and chromic acid (No. 7) was carried out to obtain a result of iron loss as shown in Table 10.

TABLE 10

| No. | Electrolytic bath halide composition | halide concentration (g/l) | polyethylene glycol molecular weight | polyethylene glycol concentration (g/l) | Bath temperature (°C.) | Electrolytic conditions current density ($A/dm^2$) | Electrolytic conditions quantity of electricity ($coulomb/dm^2$) | Dissolved thickness per surface (μm) *1 | Iron loss $W_{17/50}$ (W/kg) *2 | Remarks |
|---|---|---|---|---|---|---|---|---|---|---|
| 1 | $NH_4F$ | 70 | 1000 | 40 | 40 | 100 | 2000 | 5 | 0.81 | Acceptable Example |
| 2 | NaI | 70 | 1500 | 60 | 50 | 100 | 2000 | 5 | 0.81 | |
| 3 | NaCl<br>$NaBF_4$ | 100<br>30 | 2000 | 30 | 50 | 100 | 2000 | 5 | 0.81 | |
| 4 | NaCl<br>NaI | 150<br>30 | 1500 | 50 | 60 | 100 | 2000 | 5 | 0.79 | |
| 5 | NaF<br>KI | 50<br>50 | 6000 | 30 | 60 | 100 | 2000 | 5 | 0.82 | |
| 6 | $NH_4Cl$<br>KBr | 100<br>20 | 600 | 80 | 50 | 100 | 2000 | 5 | 0.80 | |
| 7 | $H_3PO_4$<br>$CrO_3$ | 85% 1 l<br>200 | — | — | 60 | 100 | 3000 | 5 | 0.88 | Comparative Example |

*1, *2 same in Table 2

As seen from Table 10, the improved margin of iron loss is large in the acceptable examples according to the invention as compared with that of the comparative product obtained by the conventionally known electrolytic polishing with phosphoric acid and chromic acid.

EXAMPLE 12

The same test sheet as in Example 3 was provided, which was pickled to remove the oxide coating from the surface of the sheet and then subjected to an anodically electrolytic treatment in an aqueous solution of a halide as shown in the following Table 11. Thereafter, the sheet was washed with water and subjected to a brushing treatment with a nylon brushing roll while applying an aqueous solution or suspension of a hydrogen carbonate. Then, the sheet was washed with water, dried, subjected to a coating as showing in Table 11 and further to a strain relief annealing at 800° C. for 3 hours. The magnetic properties and adhesion property of the thus obtained product were evaluated to obtain results as shown in Table 11. For the comparison, the same measurement was carried out in case of conducting no brushing treatment (No. 6) or conducting the brushing treatment only with water (No. 7) to obtain results as shown in Table 11.

In the acceptable examples according to the invention, the adhesion property is excellent and the iron loss value is good.

TABLE 11

| No. | Electrolysis in aqueous halide solution: bath component | bath concentration (g/l) | bath temperature (°C.) | electrolytic conditions current density ($A/dm^2$) | electrolytic conditions quantity of electricity ($coulomb/dm^2$) | dissolved thickness per surface (μm) *1 |
|---|---|---|---|---|---|---|
| 1 | $NH_4F$ | 50 | 40 | 70 | 2000 | 5 |
| 2 | NaCl<br>NaI | 150<br>30 | 60 | 100 | " | " |
| 3 | $NH_4Cl$<br>KBr | 100<br>20 | 50 | 100 | " | " |
| 4 | $NH_4F$<br>P.E.G *6 | 50<br>50 | 40 | 80 | " | " |
| 5 | NaI<br>P.E.G *6 | 100<br>50 | 60 | 80 | " | " |
| 6 | NaCl<br>NaI | 150<br>30 | 60 | 100 | " | " |
| 7 | $NH_4F$ | 50 | 40 | 80 | " | " |

TABLE 11-continued

| | P.E.G *6 | 50 | | | | | |
|---|---|---|---|---|---|---|---|
| | Brushing | | Coating | | | Evaluation *3 | |
| No. | liquid | concentration (g/l) | composition | coating formation | thickness (μm) | Iron loss $W_{17/50}$ (W/kg) | adhesion property to coating *5 |
| 1 | $NaHCO_3$ aqueous solution | 50 | TiN | PVD | 0.8 | 0.70 | 20 |
| 2 | $NaHCO_3$ aqueous solution | " | " | " | " | 0.69 | 20 |
| 3 | $NaHCO_3$ aqueous solution | 30 | SiN | " | 1.0 | 0.69 | 15 |
| 4 | $NaHCO_3$ aqueous solution | " | $Mg(H_2PO_4)_2$ colloidal silica $CrO_3$ | roll coat | 0.5 | 0.71 | 20 |
| 5 | $NaHCO_3$ aqueous solution | " | $Mg(H_2PO_4)_2$ colloidal silica $CrO_3$ | " | " | 0.72 | 25 |
| 6 | no brushing | — | TiN | PVD | 0.8 | 0.74 | 40 |
| 7 | water | — | $Mg(H_2PO_4)_2$ colloidal silica $CrO_3$ | roll coat | 0.5 | 0.75 | 50 |

*1 same in Table 2
*3 same in Table 6
*5 same in Table 8
*6 polyethylene glycol having a molecular weight of 2000

EXAMPLE 13

The same test sheet as in Example 3 was provided, which was pickled to remove the oxide coating from the surface of the sheet, subjected to an anodically electrolytic treatment in an aqueous solution of a halide containing an inhibitor as shown in the following Table 12, washed with water and dried, and thereafter the iron loss ($W_{17/50}$) was measured and also the corrosion resistance in wet air was examined. The same measurement was carried out with respect to the sheets treated in the bath containing no inhibitor (Nos. 6 and 7). The measured results are shown in Table 12.

TABLE 12

| | Electrolytic bath | | | | | Electrolytic conditions | | | | | |
|---|---|---|---|---|---|---|---|---|---|---|---|
| | halide | | Inhibitor | | Bath | | | Dissolved | Iron | Corrosion | |
| No. | composition | concentration (g/l) | composition | concentration (g/l) | temperature (°C.) | current density ($A/dm^2$) | quantity of electricity ($coulomb/dm^2$) | thickness per surface (μm) *1 | loss 2) $W_{17/50}$ (W/kg) *2 | resistance (hr) *7 | Remarks |
| 1 | NaCl | 200 | $K_2Cr_2O_7$ | 1 | 60 | 100 | 2000 | 5 | 0.82 | 8 | Example |
| 2 | NaCl<br>$NH_4Cl$<br>P.E.G *6 | 100<br>100<br>50 | " | 3 | " | " | " | " | 0.79 | 12 | adding inhibitor |
| 3 | NaF<br>$NH_4Cl$ | 70<br>30 | $NaNO_2$ | 5 | " | " | " | " | 0.83 | 10 | |
| 4 | NaI<br>P.E.G *6 | 100<br>30 | " | 10 | " | " | " | " | 0.80 | 15 | |
| 5 | NaF<br>KI | 50<br>50 | tri-ethanol amine | 25 | " | " | " | " | 0.82 | 8 | |
| 6 | NaCl<br>$NH_4Cl$ | 100<br>100 | none | — | " | " | " | " | 0.82 | 5 | Example adding |
| 7 | NaI<br>P.E.G *6 | 100<br>30 | none | — | " | " | " | " | 0.80 | 5 | no inhibitor |

*1, *2 same in Table 2
*7 Time occuring rust at 40° C. and relative humidity of 90%

As seen from Table 12, when the inhibitor is added to the bath, there is no problem in the improved margin of the iron loss, and particularly the corrosion resistance is excellent and the rust hardly occurs.

EXAMPLE 14

The same test sheet as in Example 3 was provided, which was pickled to remove the oxide coating from the surface of the sheet and subjected to an anodically electrolytic treatment of a halide containing a pH buffering agent or a chelating agent as shown in the following Table 13, and then the iron loss ($W_{17/50}$) was measured and also the total electrolytic time until the surface became ununiform and the gloss was lessened, i.e. the electrolytic treating capability was reduced was measured. For the comparison, the same measurement was carried out in case of using the bath containing no pH buffering agent or chelating agent (No. 6 and 7). The measured results are shown in Table 13.

TABLE 13

| No. | Electrolytic bath: halide: composition | Electrolytic bath: halide: concentration (g/l) | Electrolytic bath: Inhibitor: composition | Electrolytic bath: Inhibitor: concentration (g/l) | Bath temperature (°C.) | Electrolytic conditions: current density (A/dm²) | Electrolytic conditions: quantity of electricity (coulomb/dm²) | Dissolved thickness per surface (μm) *1 | Iron loss 2) $W_{17/50}$ (W/kg) *2 | Electrolytic time (hr/l) *8 | Remarks |
|---|---|---|---|---|---|---|---|---|---|---|---|
| 1 | $Na_4Cl$ | 100 | sodium citrate | 50 | 60 | 100 | 2000 | 5 | 0.82 | 17 | addition of chelating agent |
| 2 | NaCl<br>P.E.G *6 | 200<br>60 | EDTA | 30 | " | " | " | " | 0.79 | 14 | |
| 3 | $Na_4F$ | 100 | tri-ethanol amine | 20 | " | " | " | " | 0.82 | 15 | |
| 4 | KCl<br>NaBr<br>P.E.G *6 | 100<br>50<br>40 | $H_3BO_3$ | 25 | " | " | " | " | 0.79 | 21 | addition of pH buffering agent |
| 5 | NaF<br>KI | 50<br>50 | $NaH_2PO_4$ | 50 | " | " | " | " | 0.81 | 18 | |
| 6 | $NH_4Cl$ | 100 | — | — | " | " | " | " | 0.83 | 11 | no addition |
| 7 | KCl<br>NaBr<br>P.E.G *6 | 100<br>50<br>40 | — | — | " | " | " | " | 0.80 | 12 | |

*1, *2 same in Table 2
*6 same in Table 11
*8 Electrolizable time (minutes) per 1 l of electrolytic bath when the grain oriented silicon steel sheet having an area of 1 dm² is electrolyzed at 100 A/dm².

As seen from Table 13, when adding the pH buffering agent or the chelating agent, there is no problem in the improved margin of the iron loss value, and particularly the stable electrolysis can be attained over a long time.

EXAMPLE 15

The same test sheet as in Example 3 was provided, which was pickled to remove the oxide coating from the surface of the sheet and subjected to an anodically electrolytic treatment in an aqueous solution of a halide containing an inhibitor of a pH buffering agent as shown in the following Table 14. Thereafter, the sheet was washed with water and subjected to a brushing treatment with a nylon brushing roll while applying an aqueous solution or suspension of a hydrogen carbonate. Then, the sheet was washed with water, dried, subjected to a coating as shown in Table 14 and further to a strain relief annealing at 800° C. for 3 hours. The magnetic properties, adhesion property, corrosion resistance and electrolytic time of the thus obtained product were evaluated to obtain results as shown in Table 14. For the comparison, the same measurement was carried out in case of conducting no brushing treatment (No. 11) or conducting the brushing treatment only with water (No. 12) to obtain results as shown in Table 14. When the brushing treatment is carried out according to the invention, the adhesion property is very excellent and the iron loss value is good. Further, when the inhibitor is added, the corrosion resistance becomes particularly good, and also when adding the pH buffering agent or the chelating agent, the stable electrolysis can be conducted over a long time.

TABLE 14

| No. | Electrolysis in aqueous halide solution: bath: composition | bath: concentration (g/l) | additive: composition | additive: concentration (g/l) | bath temperature (°C.) | current density (g/l) | Brushing: liquid | Brushing: concentration (g/l) |
|---|---|---|---|---|---|---|---|---|
| 1 | NaCl | 200 | $K_2Cr_2O_7$ | 3 | 60 | 100 | $NaHCO_3$ aqueous solution | 50 |
| 2 | NaF<br>$NH_4Cl$ | 70<br>30 | hexamethylene tetramine | 25 | 50 | 50 | $NaHCO_3$ aqueous solution | " |
| 3 | NaF<br>KI | 50<br>50 | triethanol amine | 25 | " | 70 | $NaHCO_3$ aqueous solution | " |
| 4 | $NH_4Cl$ | 150 | imidazole<br>P.E.G *6 | 10<br>30 | " | 100 | $NaHCO_3$ aqueous solution | " |
| 5 | NaCl<br>KI | 100<br>50 | $NaNO_2$<br>P.E.G *6 | 20<br>20 | 60 | 80 | $NaHCO_3$ aqueous solution | " |
| 6 | KBr<br>KI | 100<br>100 | $Na_2CrO_7$<br>P.E.G *6 | 5<br>20 | " | 100 | $NaHCO_3$ aqueous solution | " |
| 7 | NaCl | 200 | $Na_2B_4O_7$ | 20 | " | 50 | $NaHCO_3$ aqueous solution | " |
| 8 | KBr | 150 | $NaH_2PO_4$ | 50 | " | 70 | $NaHCO_3$ aqueous solution | " |
| 9 | NaI | 100 | sodium citrate<br>P.E.G *6 | 40<br>30 | " | 100 | $NaHCO_3$ aqueous solution | " |
| 10 | $NH_4Cl$ | 100 | $CH_3COONa$ | 30 | " | 100 | $NaHCO_3$ | " |

TABLE 14-continued

| | | | | | | | | |
|---|---|---|---|---|---|---|---|---|
| | KI | 100 | P.E.G *6 | 50 | | | aqueous solution | |
| 11 | $NH_4Cl$ | 150 | imidazole<br>P.E.G *6 | 10<br>30 | 50 | 100 | no brushing solution | — |
| 12 | KBr | 150 | $NaH_2PO_4$ | 50 | 60 | 70 | water | — |

| | Coating | | | Brushing | | | |
|---|---|---|---|---|---|---|---|
| No. | composition | coating formation | thickness (μm) | iron loss $W_{17/50}$ (W/kg) | adhesion property to coating | Corrosion resistance (hr) *7 | Electrolytic time (min/l) |
| 1 | TiN | PVD | 1.0 | 0.68 | 20 | 10 | 11 |
| 2 | TiN | " | " | 0.70 | 20 | 11 | 12 |
| 3 | TiN | " | " | 0.71 | 20 | 9 | 16 |
| 4 | $Mg(H_2PO_4)_2$<br>colloidal silica<br>$CrO_3$ | roll coat | 0.7 | 0.72 | 25 | 12 | 11 |
| 5 | $Mg(H_2PO_4)_2$<br>colloidal silica<br>$CrO_3$ | " | " | 0.72 | 20 | 14 | 12 |
| 6 | $Mg(H_2PO_4)_2$<br>colloidal silica<br>$CrO_3$ | " | " | 0.73 | 25 | 13 | 12 |
| 7 | SiN | PVD | 0.8 | 0.70 | 15 | 5 | 18 |
| 8 | SiN | " | " | 0.71 | 20 | 6 | 20 |
| 9 | TiN | " | " | 0.69 | 15 | 5 | 20 |
| 10 | TiN | " | " | 0.69 | 15 | 5 | 16 |
| 11 | $Mg(H_2PO_4)_2$<br>colloidal silica<br>$CrO_3$ | roll coat | 0.7 | 0.76 | 50 | 12 | 11 |
| 12 | SiN | PVD | 0.8 | 0.75 | 40 | 6 | 20 |

*6 same in Table 11
*7 same in Table 12

EXAMPLE 16

A hot rolled sheet of silicon steel containing C: 0.032 wt % and Si: 3.3 wt % and MnSe and Sb as an inhibitor was cold rolled to a thickness of 0.23 mm in the usual manufacturing process of the grain oriented silicon steel sheet and subjected to a final annealing using alumina as an annealing separator. When 50 crystal grains were examined after the final annealing, the crystal grains of (110) [001] orientation (displacement angle within 5°) were 94%.

Then, the sheet was subjected to a mechanical polishing with a nonwoven cloth roll using abrasive alumina grains (vertical pressure: 1 kg/cm$^2$) and a pickling (10% $H_2SO_4$, 80° C.) to thereby remove the oxide from the surface.

Then, the sheet was subjected to an electrolytic treatment in an aqueous solution of 100 g/l of NaCl (current density: 100 A/dm$^2$) by using this sheet as an anode for 10 or 20 seconds, and then a tension coating of TiN was formed thereon. The iron loss after each treatment was measured to obtain results as shown in the following Table 15.

TABLE 15

| Treatment for removal of oxide | | | NaCl electrolysis 10 seconds | | NaCl electrolysis 20 seconds | | Iron loss after ion plating | |
|---|---|---|---|---|---|---|---|---|
| removing process | removed thickness (μm) | iron loss after removal ($W_{17/50}$:W/kg) | iron loss after electrolysis ($W_{17/50}$:W/kg) | electrolyzed thickness μm) | iron loss after electrolysis ($W_{17/50}$:W/kg) | electrolyzed thickness (μm) | followed by electrolysis for 10 seconds | Remarks |
| pickling with sulfuric acid | 10 × 2 | 1.03 | 1.05 | 2.5 × 2 | 0.81 | 5 × 2 | 0.92 | Comparative Example |
| nonwoven cloth roll #60 abrasive grains | 1 × 2 | 1.08 | 1.20 | 2.5 × 2 | 1.07 | 5 × 2 | 0.90 | |
| nonwoven cloth roll #200 abrasive grains | 1 × 2 | 0.98 | 0.83 | 2.5 × 2 | 0.81 | 5 × 2 | 0.73 | Acceptable Example |
| belt polishing #360 abrasive grains | 2 × 2 | 1.35 | 1.33 | 2.5 × 2 | 1.06 | 5 × 2 | 0.91 | Comparative Example |
| brush roll #1000 abrasive grains | 0.5 × 2 | 0.99 | 0.84 | 2.5 × 2 | 0.82 | 5 × 2 | 0.72 | Acceptable Example |
| nonwoven cloth roll #100 free abrasive grains | 0.5 × 2 | 0.97 | 0.82 | 2.5 × 2 | 0.80 | 5 × 2 | 0.70 | |

As seen from Table 15, the sheets according to the invention exhibit good properties even after the electrolytic treatment and the formation of the tension coating. On the other hand, when the pickling is carried out as a treatment for the removal of oxide, the same level of the properties is obtained by taking a long electrolytic time, but in this case the dissolved thickness of the sheet becomes very large.

EXAMPLE 17

A hot rolled sheet of silicon containing C: 0.31 wt % and Si: 3.2 wt % and AlSn and MnS as an inhibitor was cold rolled to a thickness of 0.23 mm in the usual manufacturing process of the grain oriented silicon steel sheet and subjected to a final annealing using MgO as an annealing separator. When 50 crystal grains were examined after the final annealing, the crystal grains of (110)[001] orientation (displacement angle within 5°) were 100%.

Then, the sheet was subjected to a mechanical polishing with a nonwoven cloth roll using #1500 abrasive grains (vertical pressure: 1 kg/cm$^2$) to thereby remove the oxide from the surface.

Then, the sheet was subjected to an electrolytic treatment in an aqueous solution of 100 g/l of NaCl or 50 g/l of $NH_4Cl$ (current density: 80 A/dm$^2$) by using this sheet as an anode for 10 seconds, and then a tension coating of $Si_3N_4$ was formed thereon.

For the comparison, the same final annealed sheet as mentioned above was subjected to a mechanical polishing with a nonwoven cloth roll containing #60 abrasive grains or a belt roll bonded with #1000 abrasive grains and then treated in the same manner as mentioned above.

The iron loss after each treatment was measured to obtain results as shown in the following Table 16.

TABLE 16

| Treatment for removal of oxide | | | NaCl electrolysis, 10 seconds | | Iron loss after ion plating | |
|---|---|---|---|---|---|---|
| removing process | removed thickness (μm) | iron loss after removal ($W_{17/50}$:W/kg) | iron loss after removal ($W_{17/50}$:W/kg) | electrolyzed thickness (μm) | followed by electrolysis for 10 seconds | Remarks |
| nonwoven cloth roll #60 abrasive grains | 1 × 2 | 1.08 | 1.18 | 2.5 × 2 | 1.00 | Comparative |
| belt polishing #1000 abrasive grains | 2 × 2 | 1.31 | 1.28 | 2.5 × 2 | 1.05 | Example |
| brush roll #1500 abrasive grains | 0.5 × 2 | 0.93 | 0.81 | 2.5 × 2 | 0.69 | Acceptable Example |

As seen from Table 16, the sheets according to the invention exhibit good properties even after the electrolytic treatment and the formation of the tension coating.

As mentioned above, according to the invention, the silicon-containing steel sheets having excellent iron loss properties can be obtained stably and cheaply, so that the industrialization can easily be realized. Furthermore, the adhesion property of the sheet to the coating is good.

What is claimed is:

1. In a silicon-containing steel sheet having a low iron loss, wherein said sheet has a crystal structure having crystal grains having an inclination angle of {110} face of not more than 10° with respect to the sheet surface included in an amount of not less than 80 volume percent, the novel crystal structure wherein the surfaces of said crystal grains at said sheet surface exhibit a graining pattern, and wherein the boundaries of said crystal grains form a stepwise difference or groove of not less than 0.4 μm as a maximum height.

2. The silicon-containing steel sheet according to claim 1 wherein said sheet is provided at its surface with a tension-applying insulation coating.

* * * * *

UNITED STATES PATENT AND TRADEMARK OFFICE

CERTIFICATE OF CORRECTION

PATENT NO. : 5,125,991

DATED : June 30, 1992

INVENTOR(S) : Hirotake Ishitobi et al

It is certified that error appears in the above-identified patent and that said Letters Patent is hereby corrected as shown below:

Columns 23 and 24, line 25, in Table 8, under the heading "Brushing", No. 6, under the subheading "liquid' under "$NaHCO_3$", insert --slurry--;

under the subheading "concentration (g/l), at No. 12, delete "colloidal silica $CrO_3$";

under the subheading "composition," at No. 12, under "$Mg(H_2PO_4)_2$" insert --colloidal silica $CrO_3$--.

Signed and Sealed this

Ninth Day of November, 1993

Bruce Lehman

*Attest:*

BRUCE LEHMAN

*Attesting Officer*

*Commissioner of Patents and Trademarks*